US010195854B2

(12) United States Patent
Nishida et al.

(10) Patent No.: US 10,195,854 B2
(45) **Date of Patent: *Feb. 5, 2019**

(54) PRINT DEVICE

(71) Applicant: BROTHER KOGYO KABUSHIKI KAISHA, Nagoya-shi, Aichi-ken (JP)

(72) Inventors: Katsunori Nishida, Toyoake (JP); Takao Hyakudome, Nagoya (JP); Goro Okada, Nagoya (JP); Haruo Kobayashi, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/465,024

(22) Filed: Mar. 21, 2017

(65) Prior Publication Data

US 2017/0282565 A1 Oct. 5, 2017

(30) Foreign Application Priority Data

Mar. 31, 2016 (JP) ..... 2016-073078

(51) Int. Cl.
*B41J 2/165* (2006.01)
*B41J 2/175* (2006.01)
*B41J 2/19* (2006.01)

(52) U.S. Cl.
CPC ..... *B41J 2/16505* (2013.01); *B41J 2/17596* (2013.01); *B41J 2/19* (2013.01)

(58) Field of Classification Search
CPC ..... B41J 2/16505; B41J 2/19; B41J 2/17596
See application file for complete search history.

(56) References Cited

U.S. PATENT DOCUMENTS

2016/0031222 A1* 2/2016 Kobayashi ..... B41J 2/16508 347/28
2017/0282566 A1* 10/2017 Mizutani ..... B41J 2/16505

FOREIGN PATENT DOCUMENTS

JP 2000-062213 A 2/2000
JP 2000062213 * 2/2000 ..... B41J 2/165
JP 2016-030382 A 3/2016

OTHER PUBLICATIONS

Co Pending U.S. Appl. No. 15/465,074, filed Mar. 21, 2017.

* cited by examiner

*Primary Examiner* — Henok Legesse
(74) *Attorney, Agent, or Firm* — K&L Gates LLP

(57) ABSTRACT

A print device includes a processor and a memory. The memory storing computer-readable instructions which, when executed by the processor, perform processes. The processes include covering processing controlling a cap into a covering state in which the cap covers a nozzle. The processes include first purge processing purging, in a state in which the cap is in the covering state and a supply valve is closed, an ink from the nozzle by operating a pump at a first rotation speed. The processes include injection processing injecting, after the first purge processing and in a state in which the cap is in the covering state and the supply valve is open, the cleaning liquid into the interior of the cap by operating the pump at a second rotation speed to cause the cleaning liquid to soak a nozzle face.

7 Claims, 13 Drawing Sheets

PRINT DEVICE

CROSS-REFERENCE TO RELATED APPLICATION

This application claims priority to Japanese Patent Application No. 2016-073078 filed on Mar. 31, 2016, the disclosure of which is herein incorporated by reference in its entirety.

BACKGROUND

The present disclosure relates to a print device.

An inkjet recording device is known that performs a maintenance operation that cleans a nozzle face. When it performs the maintenance operation, the inkjet recording device tightly affixes a cap to the nozzle face of a print head and, by operating a suction device, sucks ink from a nozzle that is provided in the nozzle face. Next, the inkjet recording device injects a cleaning liquid into the cap. Next, the inkjet recording device pulls the cap away from the nozzle face and wipes the nozzle face with a wiping device.

SUMMARY

This method has the advantage that, when the cleaning liquid is injected into the cap, the nozzle face is cleaned by the cleaning liquid's soaking of the nozzle face, but the cleaning liquid also destroys a meniscus inside the nozzle. When the meniscus is destroyed, ink is discharged from the nozzle into the cap.

Various embodiments of the general principles described herein provide a print device that, when the cleaning liquid is injected into the cap, cleans the nozzle face, while also decreasing the amount of the ink that is discharged from the nozzle into the cap.

Embodiments herein provide a print device that includes a head, a cap, a supply flow path, a supply valve, a waste liquid flow path, a pump, a processor and a memory. The head is provided with a nozzle face having a nozzle. The cap is configured to be affixed to the nozzle face and cover the nozzle. The supply flow path is connected to the cap and is configured to supply a cleaning liquid to the interior of the cap. The supply valve is provided in the supply flow path and is configured to open and close the supply flow path. The waste liquid flow path is connected to the cap and is configured to drain off the cleaning liquid that has been supplied to the interior of the cap. The pump is connected to the waste liquid flow path. The memory storing computer-readable instructions which, when executed by the processor, perform processes. The processes include covering processing controlling the cap into a covering state in which the cap covers the nozzle. The processes include first purge processing purging, in a state in which the cap is in the covering state and the supply valve is closed, an ink from the nozzle by operating the pump at a first rotation speed. The processes include injection processing injecting, after the first purge processing and in a state in which the cap is in the covering state and the supply valve is open, the cleaning liquid into the interior of the cap by operating the pump at a second rotation speed to cause the cleaning liquid to soak the nozzle face. The second rotation speed is slower than the first rotation speed.

BRIEF DESCRIPTION OF THE DRAWINGS

Embodiments will be described below in detail with reference to the accompanying drawings in which.

DETAILED DESCRIPTION

Figure 1:
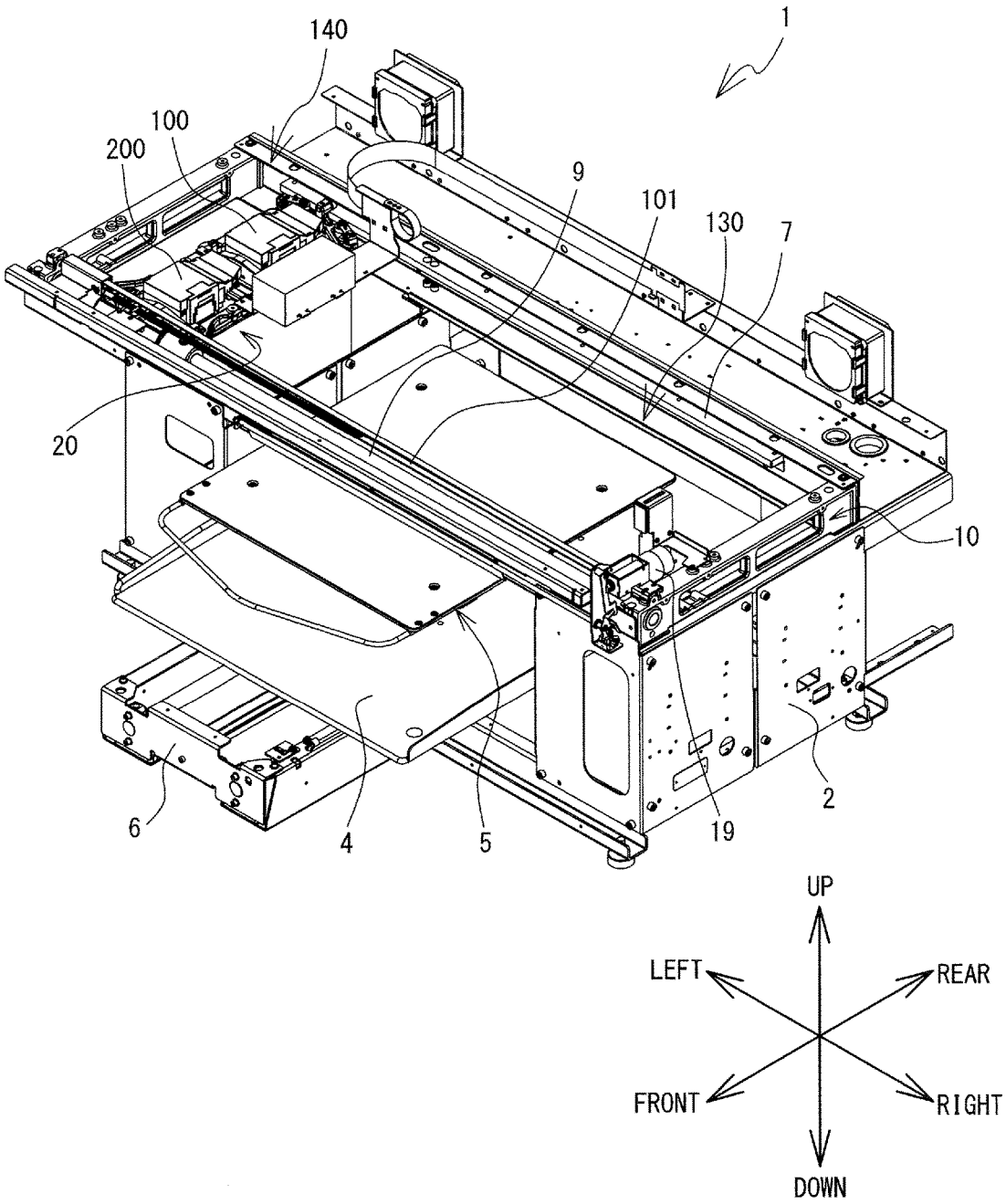
FIG. 1 is an oblique view of a printer.

The configuration of a printer 1 will be explained with reference to FIGS. 1 to 7. The top side, the bottom side, the lower left side, the upper right side, the lower right side, and the upper left side in FIG. 1 respectively correspond to the top side, the bottom side, the front side, the rear side, the right side, and the left side of the printer 1.

Mechanical Configuration of the Printer 1

The printer 1 is an inkjet printer that performs printing by discharging liquid inks 91 (refer to FIG. 10) from nozzles 112 onto a cloth such as a T-shirt or the like that is a printing medium (not shown in the drawings). The printing medium may also be a paper or the like. The printer 1 prints a color image on the printing medium by discharging downward five different types of the inks 91 (white (W), black (K), yellow (Y), cyan (C), and magenta (M)), for example. In the explanation that follows, among the five different types of the inks 91, the white ink 91 will be called the white ink. The other four types of the inks 91, black, cyan, yellow, and magenta, will be collectively called the color inks. The white ink is an ink that is more prone to sedimentation than are the color inks. The white ink is also more prone to discharge failures than are the color inks, due to clogging inside the nozzles 112.

As shown in FIG. 1, the printer 1 is provided with a housing 2, a platen drive mechanism 6, a pair of guide rails (not shown in the drawings), a platen 5, a tray 4, a frame body 10, a guide shaft 9, a rail 7, a carriage 20, head units 100, 200, a drive belt 101, and a drive motor 19.

A control portion (not shown in the drawings) that performs control of the printer 1 is provided in a position on the right front side of the housing 2. The control portion is provided with a display 49 (refer to FIG. 6) and operation buttons 501 (refer to FIG. 6). An operator operates the operation buttons 501 when inputting commands that pertain to various operations of the printer 1.

The frame body 10 has a frame shape that is substantially rectangular in a plan view, and the frame body 10 is installed in the top portion of the housing 2. The frame body 10 supports the guide shaft 9 on the front side of the flame body 10 and supports the rail 7 on the rear side of the flame body 10. The guide shaft 9 extends from left to right on the inner side of the frame body 10. The rail 7 is provided opposite the guide shaft 9 and extends from left to right.

Figure 2:
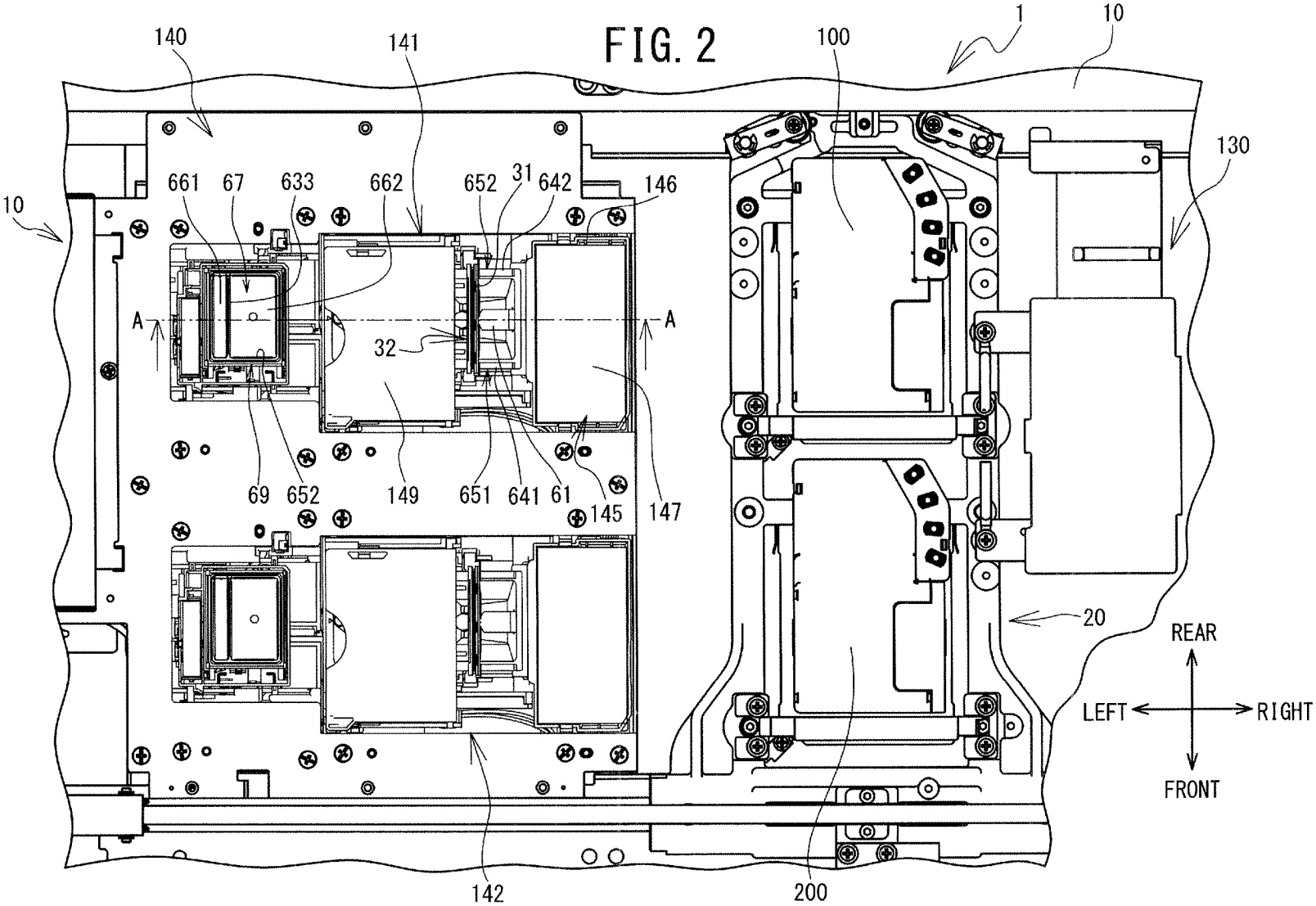
FIG. 2 is a plan view of the printer.
Figure 3:
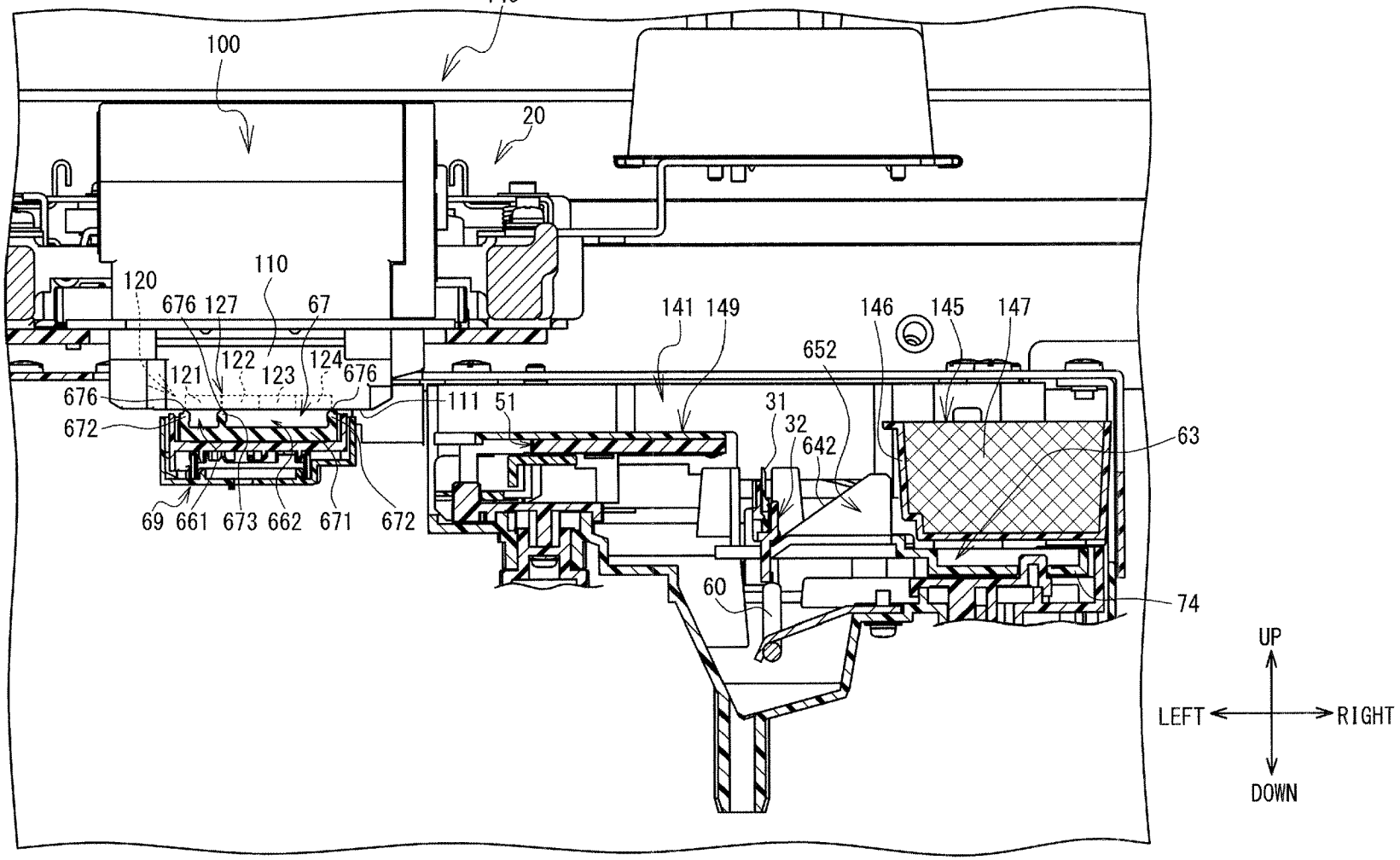
FIG. 3 is a section view along the line A-A in FIG. 2, when a wiper is in a wiper withdrawn position and a cap is in a covering position.

The carriage 20 is supported such that the carriage 20 can be conveyed to the left and the right along the guide shaft 9. As shown in FIGS. 1 and 2, the head units 100, 200 are carried on the carriage 20 and are arrayed in the front-rear direction. The head unit 100 is provided to the rear of the head unit 200. As shown in FIG. 3, the bottom portions of the head units 100, 200 are each provided with a head 110. The head 110 of the head unit 100 discharges the white ink. The head 110 of the head unit 200 discharges the color inks.

Each of the heads 110 is provided with a nozzle face 111, which is a face that has a plurality of the tiny nozzles 112 (refer to FIG. 10) that are capable of discharging the inks 91 downward. The nozzle faces 111 are flat surfaces that extend in the left-right direction and the front-rear direction, and the nozzle faces 111 form the bottom faces of the head units 100, 200. The plurality of the nozzles 112 in the nozzle face 111 are provided in a nozzle disposition area 120. The nozzle disposition area 120 is provided in the central portion of the left-right direction of the nozzle face 111 and extends in the front-rear direction.

The nozzle face 111 has nozzle arrays 121 to 124. Each one of the nozzle arrays 121 to 124 is an array of a plurality of the nozzles 112. The nozzle arrays 121 to 124 are provided in four separate areas in the left-right direction of the nozzle disposition area 120. The nozzle arrays 121 to 124 are arrayed as the nozzle array 121, the nozzle array 122, the nozzle array 123, and the nozzle array 124, in that order from left to right.

The nozzle arrays 121 to 124 of the head unit 100 are nozzle arrays that are capable of discharging the white ink. Each one of the nozzle arrays 121 to 124 of the head unit 100 is connected through a different white ink supply tube (not shown in the drawings), for example, to at least one cartridge (not shown in the drawings) that stores the white ink.

Each one of the nozzle arrays 121 to 124 of the head unit 200 is connected through a different color ink supply tube (not shown in the drawings) to an ink cartridge (not shown in the drawings) that stores the corresponding one of the color inks. For example, the nozzle array 121 is connected to a black ink cartridge, the nozzle array 122 is connected to a yellow ink cartridge, the nozzle array 123 is connected to a cyan ink cartridge, and the nozzle array 124 is connected to a magenta ink cartridge.

As shown in FIG. 1, the drive belt 101 spans the inner side of the frame body 10 in the left-right direction. The drive motor 19 is coupled to the carriage 20 through the drive belt 101. The carriage 20 is moved reciprocally to the left and the right along the guide shaft 9 by the driving of the drive belt 101 by the drive motor 19.

The platen drive mechanism 6 is provided with the pair of the guide rails (not shown in the drawings) and a platen support base (not shown in the drawings). The pair of the guide rails extend from the front to the rear on the inner side of the platen drive mechanism 6 and support the platen support base such that the platen support base can move toward the front and the rear. The top portion of the platen support base supports the platen 5. The platen 5 supports the printing medium.

The tray 4 is provided below the platen 5. When the operator places a T-shirt or the like on the platen 5, the tray 4 receives the sleeves and the like of the T-shirt, thus protecting the sleeves and the like, such that the sleeves and the like do not come into contact with other parts in the interior of the housing 2.

The platen drive mechanism 6 is driven by a sub scanning direction drive portion 46 that will be described later (refer to FIG. 6). When the platen drive mechanism 6 is thus driven, the platen drive mechanism 6 moves the platen support base and the platen 5 toward the front and the rear along the pair of the guide rails. As the platen 5 conveys the printing medium in the front-rear direction (the sub scanning direction), the inks 91 are discharged from the heads 110 as the heads 110 move reciprocally in the left-right direction (a main scanning direction). The printer 1 thus performs printing on the printing medium.

Along the path that the heads 110 travel, the area where the heads 110 perform printing will be called the printing area 130, as shown in FIGS. 1 and 2. The area along the path that the heads 110 travel that is outside the printing area 130 will be called the non-printing area 140. The non-printing area 140 is an area in the left portion of the printer 1, for example. The printing area 130 is the area from the right edge of the non-printing area 140 to the right end of the printer 1. The platen 5 and the tray 4 are provided in the printing area 130.

Various types of maintenance operations for ensuring printing quality are performed in the non-printing area 140. For example, the maintenance operations include a flushing operation, an ink purge operation, a cleaning operation, a nozzle face wiping operation, a wiper wiping operation, and the like. The flushing operation is an operation that, before printing is performed on the printing medium, discharges the inks 91 from the nozzles 112 onto a flushing receiving portion 145 that will be described later (refer to FIG. 2). Performing the flushing operation causes the inks 91 to be discharged appropriately from the nozzles 112 immediately after the printing starts. The ink purge operation is an operation (refer to FIG. 10) in which, in a state in which the areas around the nozzle faces 111 are covered by caps 67 that will be described later (refer to FIG. 2), the inks 91 are pulled out of the nozzles 112 by a suction pump 708 that will be described later. The ink purge operation discharges, along with the inks 91, any air bubbles that have gotten inside the nozzles 112, for example. It is therefore possible to decrease the possibility that the air bubbles will cause an ink discharge problem to occur. The cleaning operation is an operation that uses a cleaning liquid 92 to clean the nozzle faces 111 to which the inks 91 have adhered (refer to FIG. 12). Note that the inks 91 have a greater viscosity than does the cleaning liquid 92.

The nozzle face wiping operation is an operation in which wipers 31 that will be described later wipe off the excess inks 91 and the excess cleaning liquid 92 that are remaining on the surfaces of the nozzle faces 111 (refer to FIG. 4). When the inks 91 that are remaining on the nozzle faces 111 harden and bind to the nozzle faces 111, for example, there is a possibility that it will become difficult for the inks 91 to be discharged from the nozzle faces 111. That possibility can be decreased by performing the nozzle face wiping operation. When the inks 91 and the cleaning liquid 92 that are remaining on the nozzle faces 111 make their way into the nozzles 112, for example, there is a possibility that the meniscuses that are formed in the nozzles 112 will be affected. That possibility can also be decreased by performing the nozzle face wiping operation. The wiper wiping operation is an operation in which absorption members 51 that will be described later wipe off the inks 91 that are adhering to the wipers 31 (refer to FIG. 5). Even if the inks 91 and the cleaning liquid 92 that have been wiped off of the nozzle faces 111 are adhering to the wipers 31, the performing of the wiper wiping operation is able to decrease the possibility that the inks 91 and the cleaning liquid 92 from the wipers 31 will adhere to the nozzle faces 111 the next time that the nozzle face wiping operation is performed.

As shown in FIG. 2, the non-printing area 140 is provided with maintenance portions 141, 142. The maintenance portions 141, 142 are positioned below the travel paths of the head units 100, 200, respectively. The maintenance operations on the head units 100, 200 are performed in the maintenance portions 141, 142 under the control of a CPU 40 (refer to FIG. 6) of the printer 1. The configurations and operations of the maintenance portions 141, 142 are the same. Accordingly, in the explanation that follows, the maintenance portion 141 will be explained.

As shown in FIGS. 2 and 3, the maintenance portion 141 is provided with the wiper 31, the flushing receiving portion 145, the absorption member 51, a support plate 149, the cap 67, and a cap support portion 69. As shown in FIG. 3, the flushing receiving portion 145 is positioned in the right part of the maintenance portion 141 and above a wall portion 74 of a moving portion 63 that will be described later. The flushing receiving portion 145 is provided with a container portion 146 and an absorbent member 147. The container portion 146 is a container that is rectangular in a plan view and is open at the top. The absorbent member 147 is provided inside the container portion 146 and is a three-dimensional rectangular member that is able to absorb the ink 91. The flushing receiving portion 145 receives the ink 91 that has been discharged from the head unit 100 by the flushing operation. The ink 91 is absorbed by the absorbent member 147.

As shown in FIGS. 2 and 3, the wiper 31 is provided to the left of the flushing receiving portion 145. The wiper 31 is able to move up and down. As shown in FIG. 3, the wiper 31 is provided below the nozzle face 111. The wiper 31 extends in the front-rear direction. The top edge of the wiper 31 is parallel to the nozzle face 111. A wiper support portion 32 is provided on the bottom side of the wiper 31 and supports the wiper 31. The wiper support portion 32 has a rectangular shape, with its long axis extending in the front-rear direction, and the wiper support portion 32 has a specified width in the left-right direction. The bottom portion of the wiper support portion 32 is able to move in relation to inclined portions 641, 642 (described later), which are provided on the moving portion 63, and comes into contact with the inclined portions 641, 642. The wiper support portion 32 is energized downward by a coil spring 60 that is affixed to the bottom portion of the wiper support portion 32.

As shown in FIGS. 2 and 3, the moving portion 63 is provided with opposing wall portions 651, 652 and the wall portion 74 (refer to FIG. 3). The pair of the opposing wall portions 651, 652 face one another in the front-rear direction and are substantially triangular in a side view. The opposing wall portions 651, 652 are respectively provided with the inclined portions 641, 642.

The pair of the inclined portions 641, 642 face one another in the front-rear direction. The pair of the inclined portions 641, 642 are formed on the upper parts of the opposing wall portions 651, 652, respectively, and are components that extend obliquely downward toward the left. As shown in FIG. 3, the wall portion 74 is a wall portion that is rectangular in a plan view, and it is connected to the lower parts of the right edges of the opposing wall portions 651, 652, respectively. The wall portion 74 is connected to a second drive portion 195 that will be described later (refer to FIG. 6). The moving portion 63 is moved to the left and the right by the second drive portion 195. The wiper support portion 32 moves up and down along the inclined portions 641, 642 in conjunction with the movements of the moving portion 63 to the right and the left, respectively.

An up-down position of the wiper 31 and the wiper support portion 32 in which the wiper 31 is separated from the nozzle face 111 and the absorption member 51, as shown in FIG. 3, will be called the wiper withdrawn position. In the wiper withdrawn position, the wiper support portion 32 is in contact with the lower ends of the inclined portions 641, 642.

Figure 4:
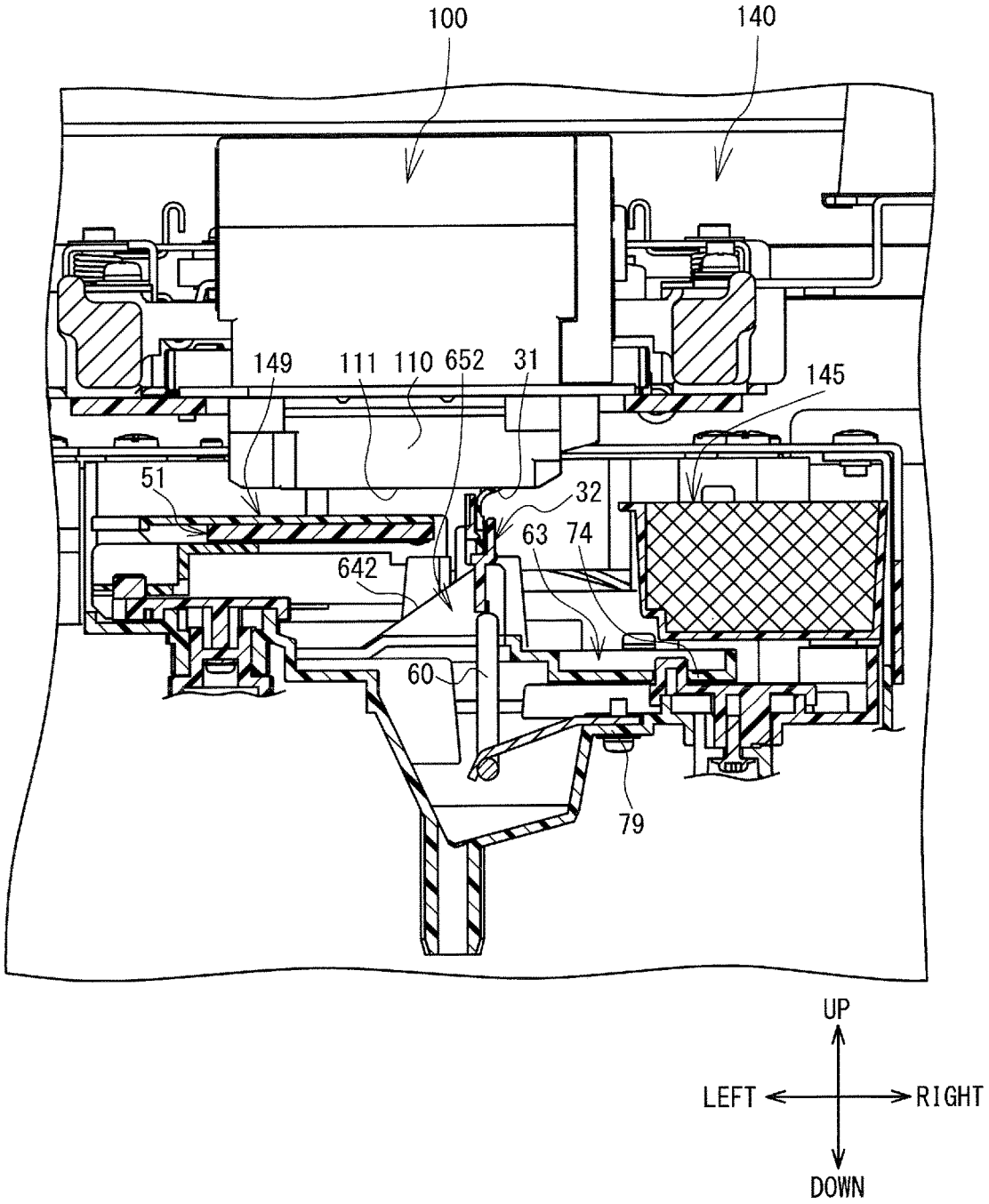
FIG. 4 is a section view that shows a state in which the wiper is in a first contact position and a nozzle face wiping operation is being performed.

An up-down position of the wiper 31 and the wiper support portion 32 in which the wiper 31 can be in contact with the nozzle face 111, as shown in FIG. 4, will be called the first contact position. In the first contact position, the wiper support portion 32 is in contact with the upper ends of the inclined portions 641, 642. In a state in which the wiper 31 and the wiper support portion 32 are in the first contact position, the moving of the carriage 20 to the right causes the wiper 31 to slide along the nozzle face 111. In that case, the wiper 31 removes the ink 91 and the cleaning liquid 92 from the nozzle face 111. In other words, the nozzle face wiping operation is performed.

Figure 5:
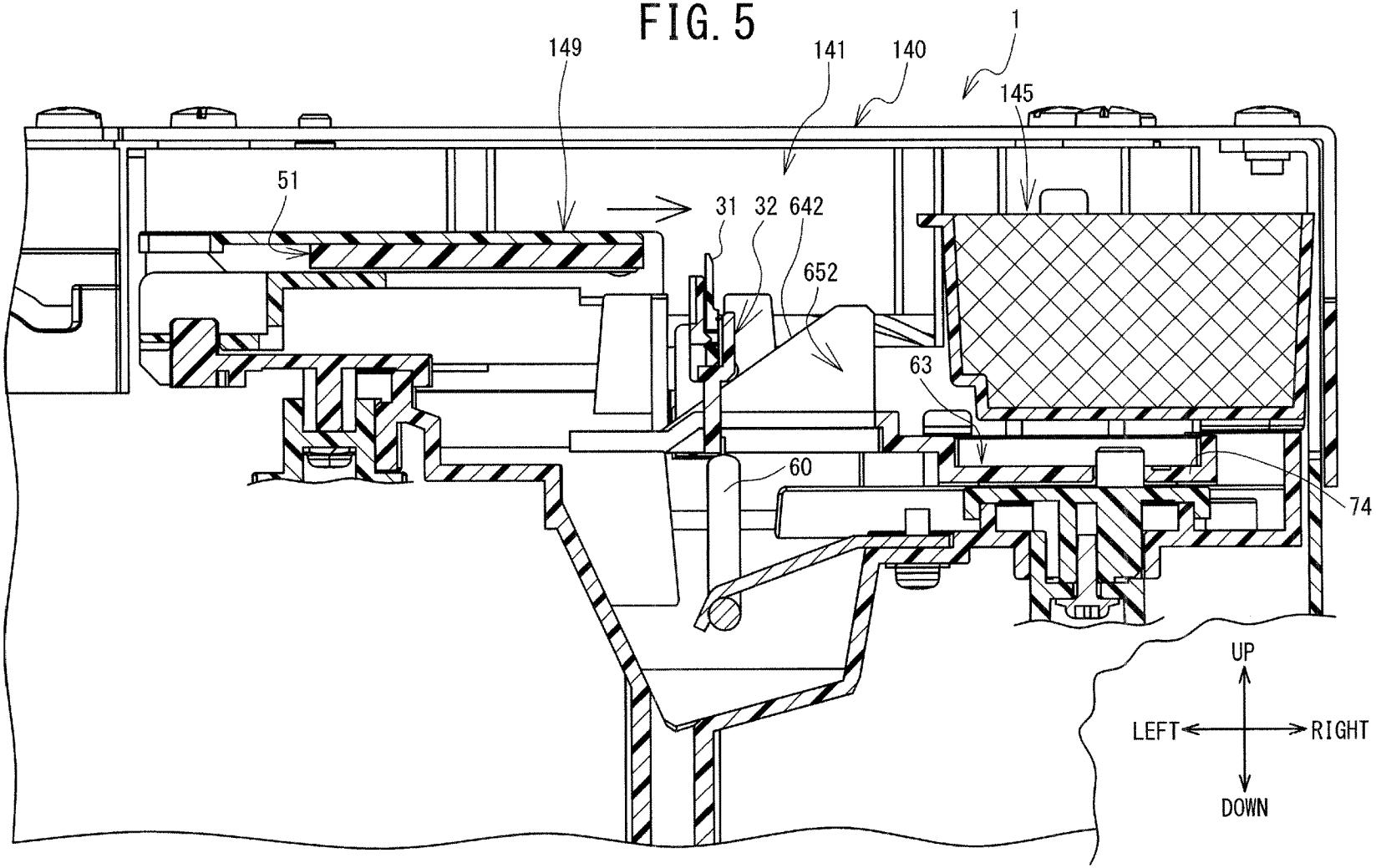
FIG. 5 is a section view that shows a state in which the wiper is in a second contact position.

An up-down position of the wiper 31 and the wiper support portion 32 in which the wiper 31 can be in contact with the absorption member 51, as shown in FIG. 5, will be called the second contact position. In the second contact position, the wiper support portion 32 is in contact with the inclined portions 641, 642 slightly below their centers in the up-down direction.

The support plate 149 is provided between the wiper 31 and the cap 67 in the left-right direction. The support plate 149 is a plate-shaped member that is rectangular in a plan view and that extends in the front-rear direction and the left-right direction. As shown in FIG. 3, the absorption member 51 is affixed to the bottom face of the support plate 149 and is supported by the support plate 149. The absorption member 51 is plate-shaped member that extends in the front-rear direction and the left-right direction. The absorption member 51 is able to absorb the ink 91 and the cleaning liquid 92.

Figure 6:
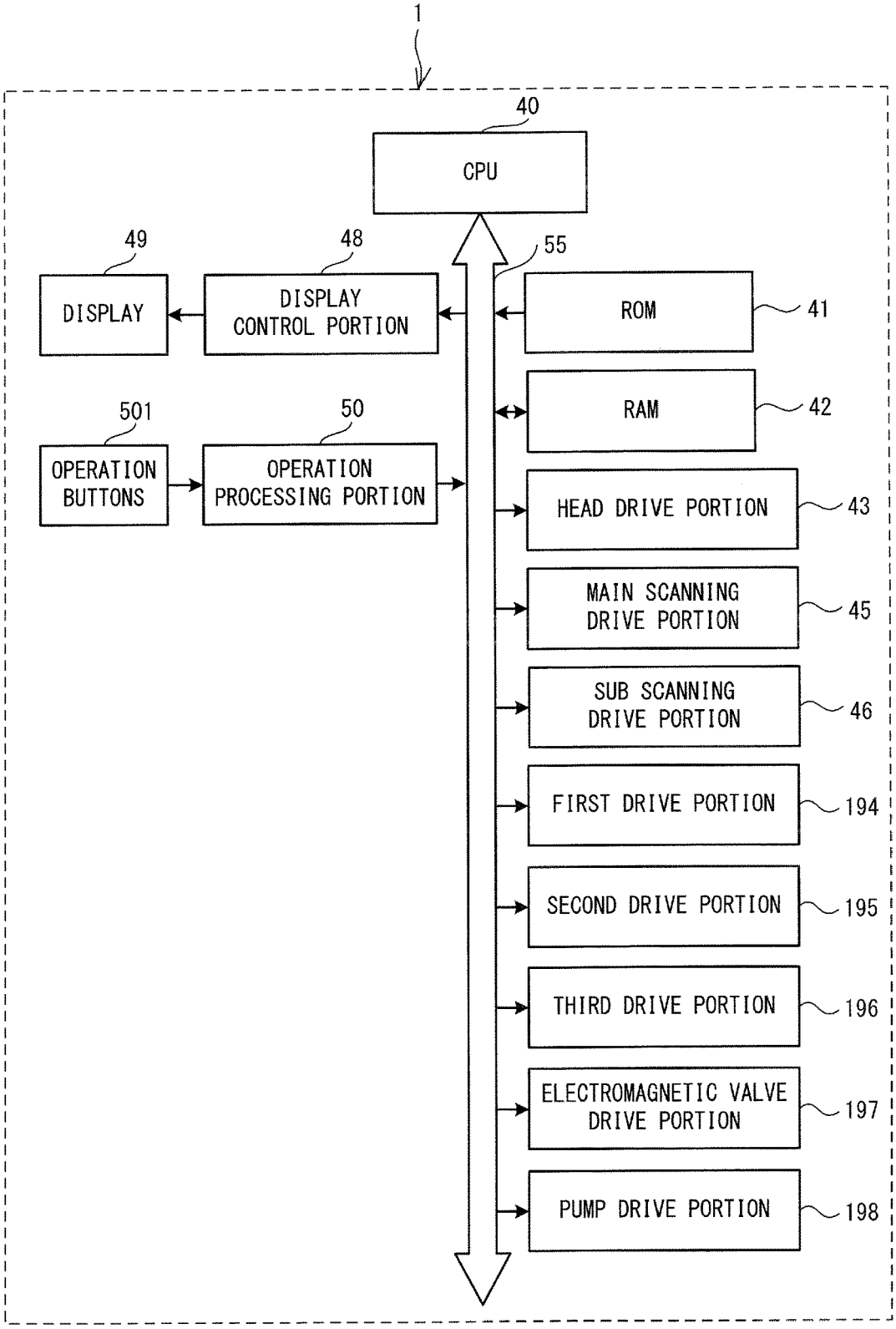
FIG. 6 is a block diagram that shows an electrical configuration of the printer.

The support plate 149 is moved to the left and the right by a first drive portion 194 (refer to FIG. 6).

In a state in which the wiper 31 and the wiper support portion 32 are in the second contact position, the moving of the support plate 149 to the right causes the wiper 31 to slide along the absorption member 51. In that case, the absorption member 51 absorbs and removes the ink 91 and the cleaning liquid 92 that have adhered to the wiper 31. In other words, the wiper wiping operation is performed.

As shown in FIGS. 2 and 3, the cap 67 and the cap support portion 69 are provided in the left portion of the maintenance portion 141. The cap 67 is included in a maintenance flow path system 700 that will be described later (refer to FIG. 7). The cap support portion 69 has a box shape that is rectangular in a plan view, and its top face is open. The cap 67 is provided on the inner side of the cap support portion 69.

The cap 67 is formed from a synthetic resin such as rubber or the like, for example. A perimeter wall 672 that configures the cap 67 extends upward from the perimeter of a bottom wall 671 that configures the cap 67. The perimeter wall 672 faces the perimeter of the nozzle disposition area 120 of the nozzle face 111 from below.

A partition wall 673 that configures the cap 67 extends upward from the bottom wall 671 and is connected to the front edge and the rear edge of the perimeter wall 672. Therefore, the partition wall 673 divides the area inside the perimeter wall 672 into two parts. In the explanation that follows, the area inside the perimeter wall 672 that is to the left of the partition wall 673 will be called the first area 661, and the area that is to the right of the partition wall 673 will be called the second area 662. The partition wall 673 faces a boundary 127 between the nozzle array 121 and the nozzle arrays 122 to 124 from below. A portion of a cap lip 676, which is formed on the upper edges of the perimeter wall 672, is at the same height as a portion of the cap lip 676, which is formed on the partition wall 673.

Figure 9:
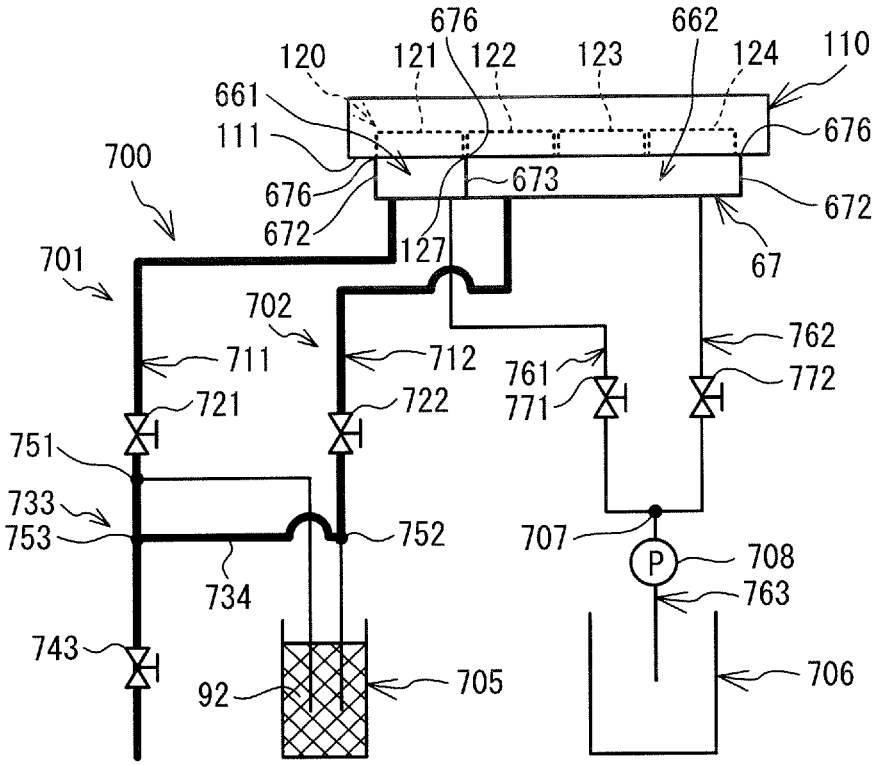
FIG. 9 is a schematic drawing of the maintenance flow path system that shows a state in which the cap has moved to the covering position.

The cap support portion 69 is moved up and down between a covering position (refer to FIGS. 3 and 9) and a cap withdrawn position (refer to FIG. 7) by the operation of a third drive portion 196 (refer to FIG. 6) that will be described later. The covering position is a position where the cap 67 is tightly affixed to the nozzle face 111, such that the cap 67 and the cap support portion 69 cover the nozzles 112. The cap withdrawn position is a position where the cap 67 has withdrawn downward from the nozzle face 111. As shown in FIGS. 3 and 9, in a case where the cap 67 and the cap support portion 69 are in the covering position, the cap lip 676 is tightly affixed to the perimeter of the nozzle disposition area 120 of the nozzle face 111 in the head unit 100, which has moved to the non-printing area 140. The plurality of the nozzles 112 are thus covered (refer to FIG. 10). The upper edge of the partition wall 673, which configures the cap lip 676, is also tightly affixed to the boundary 127 of the nozzle face 111. The ink purge operation and the cleaning operation are performed while the cap 67 and the cap support portion 69 are in the covering position.

Electrical Configuration of the Printer 1

As shown in FIG. 6, the printer 1 is provided with the CPU 40, which controls the printer 1. Through a bus 55, the CPU 40 is electrically connected to a ROM 41, a RAM 42, a head drive portion 43, a main scanning direction drive portion 45, the sub scanning direction drive portion 46, the first drive portion 194, the second drive portion 195, the third drive portion 196, an electromagnetic valve drive portion 197, a pump drive portion 198, a display control portion 48, and an operation processing portion 50.

The ROM 41 stores a control program by which the CPU 40 controls the printer 1, as well as initial values and the like. The RAM 42 temporarily stores various types of data that are used by the control program. The head drive portion 43 is electrically connected to the heads 110 that discharge the inks 91. By operating piezoelectric elements that are provided in each one of a plurality of discharge channels in the heads 110 (refer to FIG. 3), the head drive portion 43 causes the inks 91 to be discharged from the nozzles 112 (refer to FIG. 10).

The main scanning direction drive portion 45 includes the drive motor 19 (refer to FIG. 1) and moves the carriage 20 in the left-right direction (the main scanning direction). The sub scanning direction drive portion 46 includes a motor, a gear, and the like that are not shown in the drawings. By operating the platen drive mechanism 6 (refer to FIG. 1), the sub scanning direction drive portion 46 moves the platen 5 (refer to FIG. 1) in the front-rear direction (the sub scanning direction).

The first drive portion 194 includes a first drive motor (not shown in the drawings), a gear (not shown in the drawings), and the like. By moving the support plate 149 to the left and the right, the first drive portion 194 moves the absorption member 51 to the left and the right. The second drive portion 195 includes a second drive motor (not shown in the drawings), a gear (not shown in the drawings), the moving portion 63 (refer to FIG. 3), and the like. By moving the wiper support portion 32 up and down, the second drive portion 195 moves the wiper 31 up and down. The third drive portion 196 includes a third drive motor (not shown in the drawings), a gear (not shown in the drawings), and the like. By moving the cap support portion 69 up and down, the third drive portion 196 moves the cap 67 up and down.

The electromagnetic valve drive portion 197 opens and closes supply on-off valves 721, 722, an air on-off valve 743, and waste liquid on-off valves 771, 772, all of which will be described later (refer to FIG. 7). The pump drive portion 198 operates the suction pump 708, which will be described later (refer to FIG. 7). The display control portion 48 controls displays on the display 49. The operation processing portion 50 takes operational inputs to the operation buttons 501 and outputs the operational inputs to the CPU 40.

Structure of the Maintenance Flow Path System 700

Figure 7:
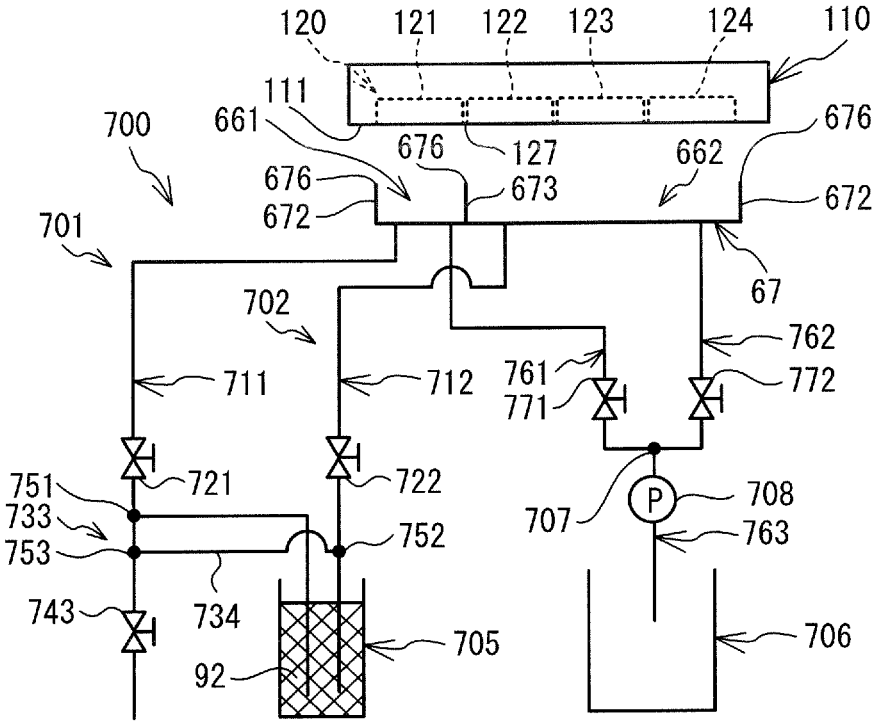
FIG. 7 is a schematic drawing of a maintenance flow path system in a state in which the cap is in a cap withdrawn position.

As shown in FIG. 7, the printer 1 is provided with the maintenance flow path system 700. To make the drawing easier to understand, the maintenance flow path system 700 and the head 110 are shown schematically in FIG. 7. The maintenance flow path system 700 is a mechanism through which the inks 91, the cleaning liquid 92, and air flow when maintenance processing that will be described later (refer to FIG. 8) is performed. The maintenance flow path system 700 is provided with a cleaning liquid tank 705, supply flow paths 711, 712, the supply on-off valves 721, 722, a gas flow path 733, a connecting path 734, the air on-off valve 743, waste liquid flow paths 761, 762, 763, the waste liquid on-off valves 771, 772, the suction pump 708, and a waste liquid tank 706.

The cleaning liquid tank 705 is a container that stores the cleaning liquid 92. The supply flow path 711 is a flow path that is connected to the cleaning liquid tank 705 and to the first area 661 in the cap 67. The operating of the suction pump 708 makes it possible for the supply flow path 711 to take the cleaning liquid 92 that is stored in the cleaning liquid tank 705 and supply the cleaning liquid 92 to the first area 661 in the cap 67. The supply flow path 712 is a flow path that is connected to the cleaning liquid tank 705 and to the second area 662 in the cap 67. In the same manner as the supply flow path 711, the supply flow path 712 is able to supply the cleaning liquid 92 to the second area 662 in the cap 67.

The supply on-off valves 721, 722 are electromagnetic valves that are provided in the supply flow paths 711, 712 and that open and close the supply flow paths 711, 712. The gas flow path 733 is connected to the supply flow path 711 at a convergence portion 751 that is located between the supply on-off valve 721 and the cleaning liquid tank 705. Therefore, the gas flow path 733 is connected to the first area 661 of the cap 67 through the supply flow path 711. The opposite end of the gas flow path 733 from the convergence portion 751 is open to the atmosphere. Therefore, the gas flow path 733 is a flow path through which air can pass. The air on-off valve 743 is an electromagnetic valve that is provided in the gas flow path 733, and the air on-off valve 743 opens and closes the gas flow path 733. The gas flow path 733 is also connected to the supply flow path 712 by the connecting path 734. One end of the connecting path 734 is connected to a convergence portion 753 between the convergence portion 751 and the air on-off valve 743. The other end of the connecting path 734 is connected to the supply flow path 712 at a convergence portion 752 that is located between the supply on-off valve 722 and the cleaning liquid tank 705. Therefore, the gas flow path 733 is connected to the second area 662 of the cap 67 through the connecting path 734 and the supply flow path 712.

Note that the gas flow path 733 may also be connected directly to the cap 67, without being connected to the supply flow paths 711, 712. In that case, the single gas flow path 733 may be divided into two branches, with one branch being connected to the first area 661 and the other branch being connected to the second area 662. The gas flow path 733 may also be provided in the form of two gas flow paths, with one of the gas flow paths 733 being connected to the first area 661 and the other of the gas flow paths 733 being connected to the second area 662. The convergence portion 752 may also be located between the cap 67 and the supply on-off valve 722 in the supply flow path 712, and the convergence portion 753 may also be located between the cap 67 and the supply on-off valve 721 in the supply flow path 711. In that case, the gas flow path 733, which is connected to the convergence portions 752, 753, may be provided as a single gas flow path, and the gas flow path 733 may also be provided in the form of two gas flow paths.

The waste liquid flow path 761 is connected to the first area 661 of the cap 67. The waste liquid flow path 762 is connected to the second area 662 of the cap 67. The waste liquid flow paths 761, 762 converge at a convergence portion 707 to form the single waste liquid flow path 763. The waste liquid flow path 763 is connected to the waste liquid tank 706. The waste liquid tank 706 is a container that stores the inks 91 and the cleaning liquid 92 that have been drained out of the cap 67. The suction pump 708 is provided in the waste liquid flow path 763. The operation of the suction pump 708 enables the waste liquid flow paths 761, 762, 763 to drain the inks 91 and the cleaning liquid 92 out of the cap 67. The waste liquid on-off valves 771, 772 are electromagnetic valves that are provided in the waste liquid flow paths 761, 762 and that open and close the waste liquid flow paths 761, 762.

In the explanation that follows, the supply flow path 711, the gas flow path 733, and the waste liquid flow paths 761, 763, all of which are connected to the first area 661, will be called a first flow path system 701. The supply flow path 712, the gas flow path 733, the connecting path 734, and the waste liquid flow paths 762, 763, all of which are connected to the second area 662, will be called a second flow path system 702.

Maintenance Processing

Figure 8:
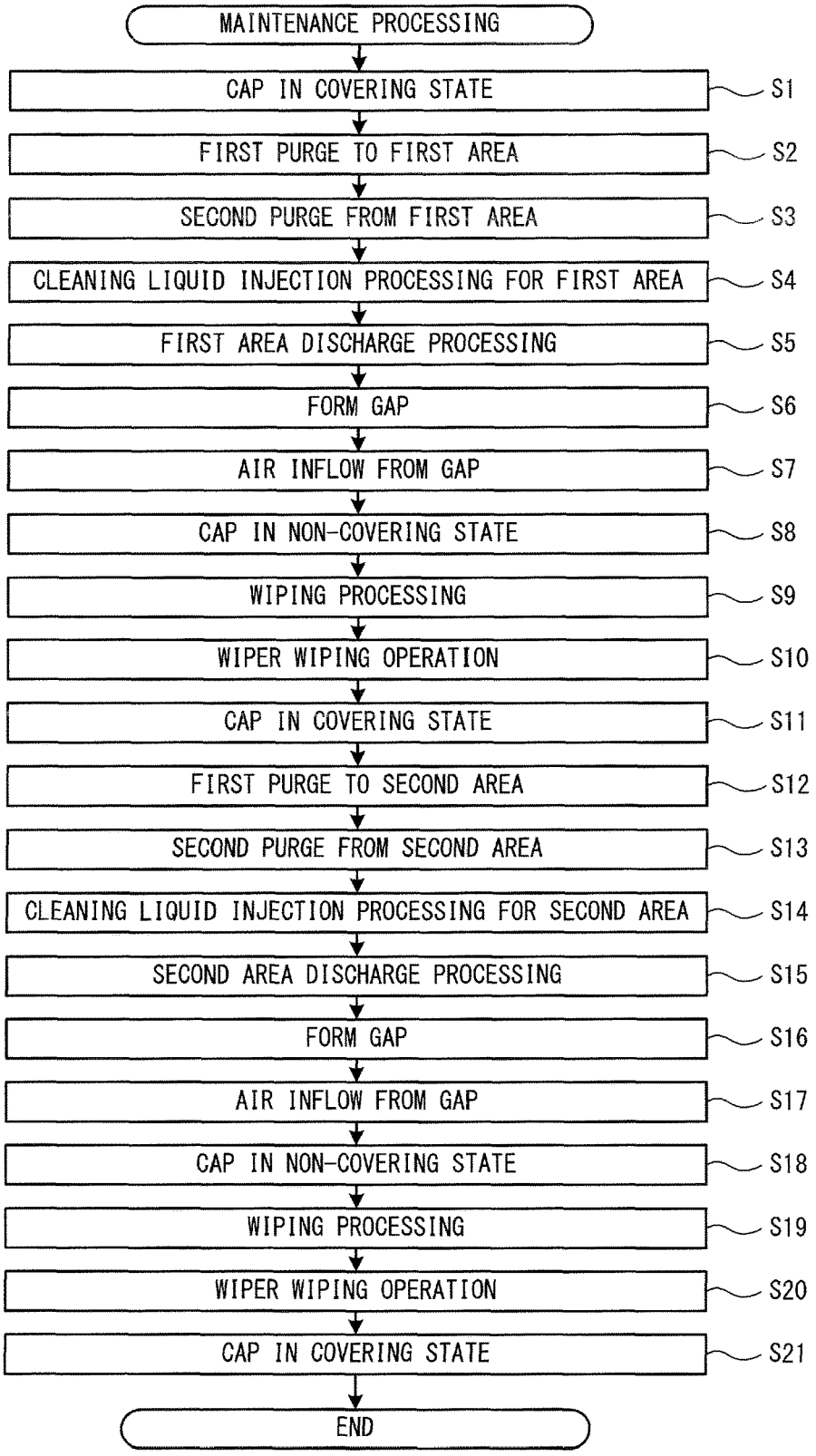
FIG. 8 is a flowchart of maintenance processing.

A first purge, a second purge, injection processing for the cleaning liquid 92, wiping processing, the wiper wiping operation, and the like are performed in the maintenance processing that is shown in FIG. 8. The CPU 40 reads the control program that is stored in the ROM 41 and controls the printer 1 to perform the maintenance processing.

Before the maintenance processing is performed, the cap 67 is positioned in the cap withdrawn position, as shown in FIG. 7, and the wiper 31 is positioned in the wiper withdrawn position, as shown in FIG. 3. When starting the maintenance processing, the CPU 40 operates the third drive portion 196 (refer to FIG. 6) to move the cap support portion 69 upward, thus moving the cap 67 from the cap withdrawn position (refer to FIG. 7) to the covering position (refer to FIGS. 3 and 9) (Step S1). The cap 67 thus enters a covering state in which it covers the nozzle face 111 (Step S1). Note that if either the air on-off valve 743 is closed or the supply on-off valves 721, 722 are closed when Step S1 is performed, there is a possibility that the air in the interior of the first area 661 and the second area 662 will be compressed when the cap 67 is pressed against the nozzle face 111. That would create a repulsive force that would make it difficult for the cap lip 676 of the cap 67 to be affixed tightly to the nozzle face 111. Therefore, when the CPU 40 will perform Step S1, that is, before the cap lip 676 is affixed tightly to the nozzle face 111, the CPU 40 opens the first area 661 and the second area 662 to the atmosphere by opening the air on-off valve 743 and the supply on-off valves 721, 722, as shown in FIG. 9. The air inside the first area 661 and the second area 662 thus easily escapes to the outside through the gas flow path 733, such that the cap lip 676 is smoothly affixed tightly to the nozzle face 111. Note that the air on-off valve 743 may also be left closed.

In FIGS. 9 to 13, the flow paths that are open based on the open/closed statuses of the individual electromagnetic valves are indicated by bolder lines than the other flow paths. As shown in FIG. 9, in the covering state, the nozzle array 121 is provided inside the first area 661, and the nozzle arrays 122 to 124 are provided inside the second area 662.

After the processing at Step S1, the CPU 40 performs the processing at Steps S2 to S10. At Steps S2 to S10, the first flow path system 701 is used in the performing of the ink purge operation, the cleaning operation, and the like on the first area 661, after which the nozzle face wiping operation and the wiper wiping operation are performed. While the CPU 40 is performing Steps S2 to S10, unless otherwise specified, it is preferable for the supply on-off valve 722 and the waste liquid on-off valve 772, which are the electromagnetic valves that are located in the second flow path system 702, to be closed. The air on-off valve 743 may be closed, and the air on-off valve 743 may also be open. Accordingly, in the following explanation of the processing at Steps S2 to S10, an explanation of the control of the electromagnetic valves that are located in the second flow path system 702 will be omitted.

Figure 10:
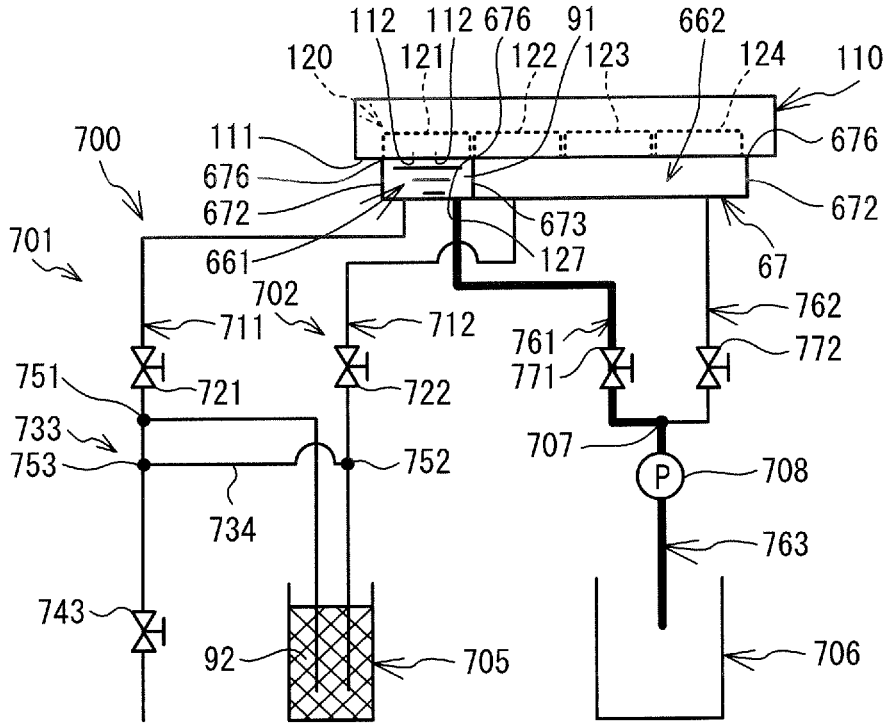
FIG. 10 is a schematic drawing of the maintenance flow path system that shows a state in which an ink has been pulled from a nozzle into a first area.

The CPU 40 performs the first purge (Step S2), which draws the ink 91 inside the nozzles 112 of the nozzle array 121 into the first area 661 of the cap 67, as shown in FIG. 10. At Step S2, the CPU 40 controls the individual electromagnetic valves such that the cleaning liquid 92 from the supply flow path 711 and the air from the gas flow path 733 are not introduced into the first area 661. For example, the CPU 40 may close the supply on-off valve 721 and the air on-off valve 743, and operate the suction pump 708 at a first rotation speed for a first time period. Note that the waste liquid on-off valve 771 may be opened either before or after the suction pump 708 starts operating at the first rotation speed. The first rotation speed may be 3000 rpm, for example, and the first time period may be 1 to 3 seconds, for example. Because the supply on-off valve 721 and the air on-off valve 743 are closed, a negative pressure is created inside the first area 661 by the suction of the suction pump 708 inside the first area 661. The ink 91 inside the nozzles 112 of the nozzle array 121 is thus drawn into the first area 661. A portion of the ink 91 that is drawn out may also flow to the waste liquid tank 706 through the waste liquid flow paths 761, 763.

Figure 11:
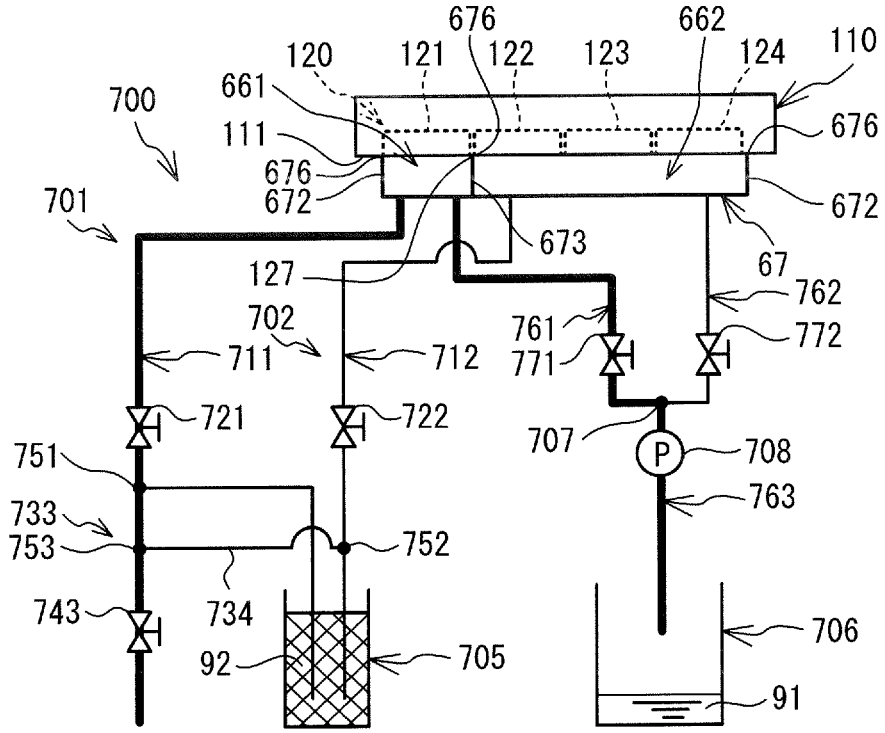
FIG. 11 is a schematic drawing of the maintenance flow path system that shows a state in which the ink has been drained from the first area.

Next, the CPU 40 performs the second purge (Step S3), which takes the ink 91 that was drawn into the first area 661 from the nozzles 112 at Step S2 and drains the ink 91 out through the waste liquid flow paths 761, 763, such that none of the ink 91 remains in the first area 661. In the second purge, the CPU 40 controls the individual electromagnetic valves such that the air from the gas flow path 733 is introduced into the first area 661 without introducing the cleaning liquid 92 from the supply flow path 711 into the first area 661, as shown in FIG. 11. For example, the CPU 40 opens the supply on-off valve 721 and the air on-off valve 743 and operates the suction pump 708 at a third rotation speed for a second time period. Note that the waste liquid on-off valve 771 may be opened either before or after the suction pump 708 starts operating at the third rotation speed. The third rotation speed may be 300 rpm, for example, and the second time period may be 30 seconds, for example. The suction force of the suction pump 708 causes air to flow into the first area 661 through the gas flow path 733 and causes the ink 91 inside the first area 661 to be drained into the waste liquid tank 706 through the waste liquid flow paths 761, 763.

Figure 12:
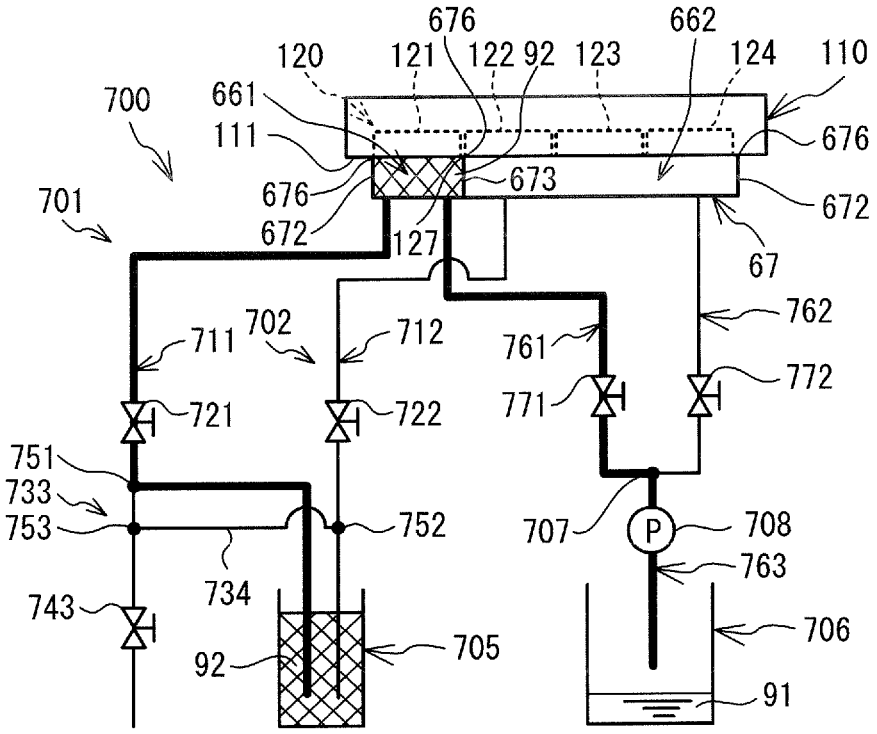
FIG. 12 is a schematic drawing of the maintenance flow path system that shows a state in which a cleaning liquid has been injected into the first area.

Next, the CPU 40 performs the injection processing (Step S4), which injects the cleaning liquid 92 from the cleaning liquid tank 705 into the first area 661 of the cap 67 through the supply flow path 711. The CPU 40 starts the injection processing by operating the valves. For example, the CPU 40 opens the supply on-off valve 721 and the waste liquid on-off valve 771 and closes the air on-off valve 743, as shown in FIG. 12.

Next, the CPU 40 operates the suction pump 708 at a second rotation speed, which is slower than the first rotation speed at Step S2. For example, the second rotation speed may be not greater than 800/3000 of the first rotation speed, or 800 rpm. Note that the second rotation speed may be greater than the third rotation speed at Step S3. In a case where the suction pump 708 is a tube pump, the CPU 40 may operate the pump at the second rotation speed for two rotations, for example, but it is not limited to two rotations and may also operate the pump for one rotation and for more than two rotations. When the suction pump 708 is operated at the second rotation speed, the cleaning liquid 92 soaks the nozzle face 111. The nozzle face 111 is thereby cleaned by the cleaning liquid 92. At the same time, because the cleaning liquid 92 destroys the meniscuses in the nozzles 112, the ink 91 is expelled from the nozzles 112 into the first area 661 as the cleaning liquid 92 makes its way into the nozzles 112.

Soaking

The inventor has confirmed that the cleaning liquid 92 soaks the nozzle face 111 in the injection processing under the following conditions:

(1) The second area 662 that is shown in FIG. 2 measures 22 millimeters from left to right and 39 millimeters from front to rear, and a distance L from the nozzle face 111 to the bottom face of the second area 662 is 1.1 millimeters. In other words, a surface area S of the second area 662 in a plan view is 858 square millimeters, and a volume V of the second area 662 is 943.8 cubic millimeters.

(2) The second rotation speed in the injection processing is 300 rpm.

(3) A surface tension F of the cleaning liquid 92 is 68.5 mN/m.

Note that the first area 661 that is shown in FIG. 2 measures 6 millimeters from left to right and 39 millimeters from front to rear, and the distance L from the nozzle face 111 to the bottom face of the first area 661 is 1.1 millimeters. In other words, the surface area S of the first area 661 in a plan view is 234 square millimeters, and the volume V of the first area 661 is 257.4 cubic millimeters. Accordingly, the volume V of the first area 661 is smaller than the volume V of the second area 662. Therefore, in the injection processing, if the cleaning liquid 92 soaks the nozzle face 111 in the second area 662 under the conditions (2) and (3), then it stands to reason that the cleaning liquid 92 will soak the nozzle face 111 in the first area 661 under the conditions (2) and (3).

Based on the confirmed results for the conditions (1) to (3) above, it is thought that in the injection processing, the cleaning liquid 92 will soak the nozzle face 111 under the conditions hereinafter described. Specifically, if the volumes V of the spaces within the cap 67 to which the suction pump 708 applies suction are reduced, the amount of the cleaning liquid 92 that is needed to fill the spaces will be reduced. Accordingly, it becomes easier for the cleaning liquid 92 to soak the nozzle face 111. Therefore, one of the surface area S and the distance L may be reduced in order to reduce the volume V. Reducing the distance L shortens the distance to the nozzle face 111, so that is desirable for soaking purposes.

Soaking also becomes easier in the injection processing if the second rotation speed is not less than 300 rpm, because the suction force with which the suction pump 708 draws the cleaning liquid 92 into the spaces inside the cap 67 becomes stronger. If the rotation speed of the suction pump 708 is less than the first rotation speed during the first purge at Step S2, then the amount of the ink 91 that is expelled from the nozzles 112 when the cleaning liquid 92 is injected into the cap 67 can be reduced from what it would be if the rotation speed of the suction pump 708 were the same as the first rotation speed at Step S2.

The cleaning liquid 92 also spreads more readily, and soaking becomes more difficult, if the surface tension F of the cleaning liquid 92 is less than 68.5 mN/m. Conversely, the cleaning liquid 92 becomes more resistant to spreading, and soaking becomes easier, if the surface tension F of the cleaning liquid 92 is not less than 68.5 mN/m. Note that the cleaning liquid 92 contains a surface active agent, and if the ratio of the surface active agent increases, the surface tension F becomes greater. The surface tension of the ink 91 is approximately 30 mN/m, and the surface tension F of the cleaning liquid 92 is higher than the surface tension of the ink 91.

After operating the suction pump 708 at that second rotation speed, the CPU 40 stops the suction pump 708. The CPU 40 may stop the suction pump 708 for 1 second, for example. Next, the CPU 40 operates the suction pump 708 once again at the second rotation speed. In a case where the suction pump 708 is a tube pump, the CPU 40 may operate the pump at the second rotation speed for two rotations, for example, but it is not limited to two rotations and may also operate the pump for one rotation and for more than two rotations. The CPU 40 operates the suction pump 708 intermittently at the second rotation speed for a total of seven sets of on/off operation. It is thus possible to reduce the possibility that the negative pressure will become too high. Note that the negative pressure becomes high means that the absolute value of the pressure decreases. Note also that during the on/off operation, the rotation speed and the stop times of the suction pump 708 do not need to be constant. The rotation speed may vary by several hundred rpm, and the stop time may vary by several seconds. The operation and the stopping are also not limited to seven sets and need only to be a plurality of sets. After repeating the on/off operation for seven sets, the CPU 40 terminates the injection processing at Step S4 and advances the processing to Step S5.

In the injection processing at Step S4, the suction force of the suction pump 708 causes the cleaning liquid 92 to flow from the cleaning liquid tank 705 to the first area 661 through the supply flow path 711, as shown in FIG. 12. The cleaning liquid 92 thus fills the first area 661 and soaks the nozzle face 111. When the cleaning liquid 92 soaks the nozzle face 111, the part of the nozzle face 111 where the nozzle array 121 is located and the part of the cap 67 that is inside the first area 661 are cleaned by the cleaning liquid 92. And because the cleaning liquid 92 flows to the waste liquid tank 706 through the waste liquid flow paths 761, 763, the waste liquid flow paths 761, 763 are also cleaned.

Figure 13:
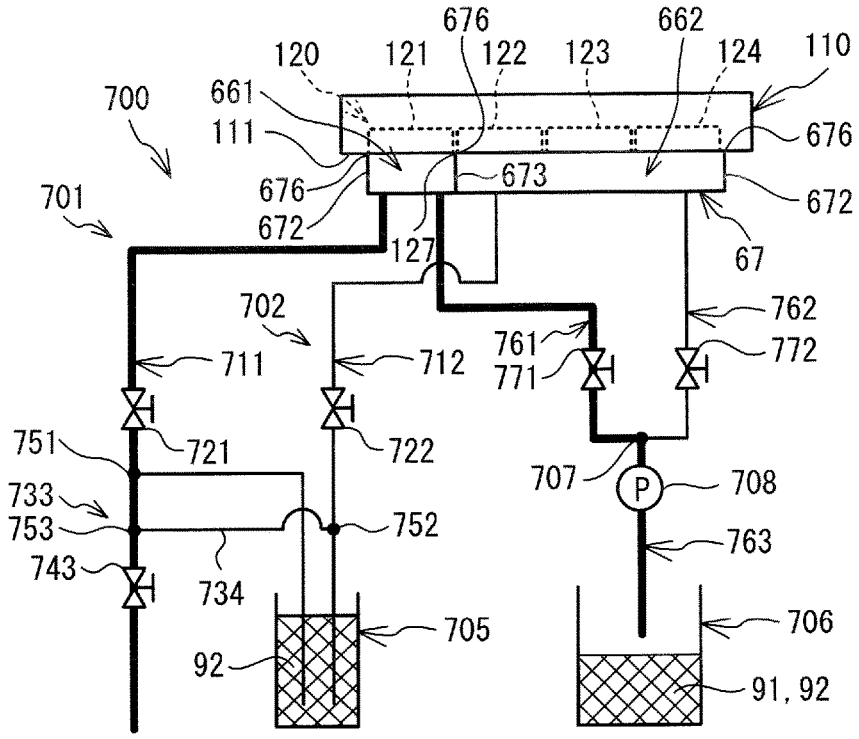
FIG. 13 is a schematic drawing of the maintenance flow path system that shows a state in which the cleaning liquid has been drained from the first area.

The CPU 40 performs discharge processing (Step S5) that discharges the cleaning liquid 92 from the first area 661 through the waste liquid flow paths 761, 763. In the discharge processing (Step S5), the CPU 40 leaves the supply on-off valve 721 and the waste liquid on-off valve 771 open and opens the air on-off valve 743, as shown in FIG. 13, then operates the suction pump 708 at a fourth rotation speed. The fourth rotation speed is 800 rpm, for example. The suction force of the suction pump 708 causes air to flow into the first area 661 through the gas flow path 733 and also causes the cleaning liquid 92 in the first area 661 to be drained into the waste liquid tank 706 through the waste liquid flow paths 761, 763.

Next, the CPU 40 operates the third drive portion 196 (refer to FIG. 6) to form a gap between the nozzle face 111 and the perimeter of the cap 67 (Step S6). The operating of the third drive portion 196 may cause the cap support portion 69 to tilt in relation to the front-rear direction and the left-right direction, for example. Note that the suction pump 708 is not operated during the processing at Step S6.

Next, the CPU 40 leaves the waste liquid on-off valve 771 open and closes the supply on-off valve 721 and the air on-off valve 743, then operates the suction pump 708 (Step S7). The suction force of the suction pump 708 causes air to flow into the first area 661 through the gap in the perimeter of the cap 67. The inflowing air removes bubbles of the cleaning liquid 92 that are clinging to the cap lip 676 and causes the removed bubbles to flow to the waste liquid tank 706 through the waste liquid flow paths 761, 763.

Next, the CPU 40 operates the third drive portion 196 to move the cap support portion 69 downward, thus moving the cap 67 to the cap withdrawn position (refer to FIG. 7) (Step S8). The cap 67 thus enters a non-covering state in which the cap 67 no longer covers the nozzle face 111.

Next, the CPU 40 performs the wiping processing (Step S9), which performs the nozzle face wiping operation. At Step S9, the CPU 40 operates the second drive portion 195 (refer to FIG. 6) to move the wiper 31 and the wiper support portion 32 from the wiper withdrawn position (refer to FIG. 3) to the first contact position, as shown in FIG. 4. The CPU 40 operates the main scanning direction drive portion 45 (refer to FIG. 6) to move the carriage 20 toward the right. The wiper 31 thus slides along the nozzle face 111 and wipes off the cleaning liquid 92 and the ink 91 that are remaining on the surface of the nozzle face 111. Note that it is also acceptable to perform the nozzle face wiping operation only in the wiping processing at Step S19, which will be described later, without performing the wiping processing at Step S9.

Next, the CPU 40 performs the wiper wiping operation (Step S10). At Step S10, the CPU 40 operates the second drive portion 195 to move the wiper 31 and the wiper support portion 32 from the first contact position (refer to FIG. 4) to the second contact position, as shown in FIG. 5. The CPU 40 operates the first drive portion 194 to move the absorption member 51 toward the right. The bottom face of the absorption member 51 thus slides along the wiper 31 and wipes off the cleaning liquid 92 and the ink 91 that are adhering to the wiper 31. The CPU 40 operates the second drive portion 195 to move the wiper 31 from the second contact position (refer to FIG. 5) to the wiper withdrawn position (refer to FIG. 3). The CPU 40 operates the first drive portion 194 (refer to FIG. 6) to move the support plate 149 and the absorption member 51, which have moved to the right, toward the left. The CPU 40 operates the main scanning direction drive portion 45 to move the carriage 20 toward the left and position the nozzle face 111 above the cap 67. Note that it is also acceptable to perform the wiping off of the cleaning liquid 92 and the ink 91 that are adhering to the wiper 31 only in the wiper wiping operation at Step S20, which will be described later, without performing the wiper wiping operation at Step S10.

Next, in the same manner as at Step S1, the CPU 40 operates the third drive portion 196 (refer to FIG. 6) to move the cap support portion 69 upward, thus moving the cap 67 from the cap withdrawn position (refer to FIG. 7) to the covering position (refer to FIGS. 3 and 9) (Step S11). The cap 67 thus enters the covering state in which the cap 67 covers the nozzle face 111.

Next, the processing at Steps S12 to S20 is performed. At Steps S12 to S20, the second flow path system 702 is used in the performing of the first purge, the second purge, the cleaning liquid 92 injection processing, and the like on the second area 662, and then the wiping processing and the wiper wiping operation are performed. In other words, the same sort of processing that was performed on the first area 661 at Steps S2 to S10 is performed on the second area 662. The processing at Steps S12 to S20 corresponds to the processing at Steps S2 to S10, so in the explanation that follows, certain details will be omitted. While the CPU 40 is performing Steps S12 to S20, unless otherwise specified, it is preferable for the supply on-off valve 721 and the waste liquid on-off valve 771, which are the electromagnetic valves that are located in the first flow path system 701, to be closed. The air on-off valve 743 may be closed, and the air on-off valve 743 may also be open. Accordingly, in the following explanation of the processing at Steps S12 to S20, an explanation of the control of the electromagnetic valves that are located in the first flow path system 701 will be omitted.

The CPU 40 performs the first purge (Step S12), which draws the ink 91 inside the nozzles 112 of the nozzle arrays 122 to 124 into the second area 662 of the cap 67. At Step S12, the CPU 40 controls the individual electromagnetic valves such that the cleaning liquid 92 from the supply flow path 712 and the air from the gas flow path 733 are not introduced into the second area 662. For example, the CPU 40 may close the supply on-off valve 722 and the air on-off valve 743, then operate the suction pump 708 at the first rotation speed for the first time period (Step S12). Note that the waste liquid on-off valve 772 may be opened either before or after the suction pump 708 starts operating at the first rotation speed. The ink 91 inside the nozzles 112 in the nozzle arrays 122 to 124 is thus drawn into the second area 662 (Step S12), in the same manner that the ink 91 was drawn into the first area 661, as shown in FIG. 10.

Next, the CPU 40 performs the second purge (Step S13), which takes the ink 91 that was drawn into the second area 662 from the nozzles 112 at Step S12 and drains the ink 91 out through the waste liquid flow paths 762, 763, such that none of the ink 91 remains in the second area 662. In the second purge, the CPU 40 controls the individual electromagnetic valves such that the air from the gas flow path 733 is introduced into the second area 662 without introducing the cleaning liquid 92 from the supply flow path 712 into the second area 662. For example, the CPU 40 opens the supply on-off valve 722 and the air on-off valve 743 and operates the suction pump 708 at the third rotation speed for the second time period (Step S13). Note that the waste liquid on-off valve 772 may be opened either before or after the suction pump 708 starts operating at the third rotation speed. The ink 91 inside the second area 662 is thus drained into the waste liquid tank 706 through the waste liquid flow paths 762, 763, in the same way that is shown in FIG. 11 for the first area 661.

Next, the CPU 40 performs the injection processing (Step S14), which injects the cleaning liquid 92 from the cleaning liquid tank 705 into the second area 662 of the cap 67 through the supply flow path 712. The CPU 40 starts the injection processing by operating the valves. For example, the CPU 40 opens the supply on-off valve 722 and the waste liquid on-off valve 772 and closes the air on-off valve 743. Next, the CPU 40 operates the suction pump 708 at the second rotation speed, which is slower than the first rotation speed at Step S12. Note that the second rotation speed may be greater than the third rotation speed at Step S13. In a case where the suction pump 708 is a tube pump, the CPU 40 may operate the pump at the second rotation speed for two rotations, for example, but it is not limited to two rotations and may also operate the pump for one rotation and for more than two rotations. The surface area S of the second area 662 in a plan view is greater than the surface area S of the first area 661, and the injection processing is performed in accordance with the conditions that were described previously. Therefore, when the suction pump 708 is operated at the second rotation speed, the cleaning liquid 92 fills the second area 662, and the cleaning liquid 92 soaks the nozzle face 111. The nozzle face 111 is thereby cleaned by the cleaning liquid 92. At the same time, because the cleaning liquid 92 destroys the meniscuses in the nozzles 112, the ink 91 is expelled from the nozzles 112 into the second area 662 as the cleaning liquid 92 makes its way into the nozzles 112.

After operating the suction pump 708 at that second rotation speed, the CPU 40 stops the suction pump 708. The CPU 40 may stop the suction pump 708 for 1 second, for example. Next, the CPU 40 operates the suction pump 708 once again at the second rotation speed. In a case where the suction pump 708 is a tube pump, the CPU 40 may operate the pump at the second rotation speed for two rotations, for example, but it is not limited to two rotations and may also operate the pump for one rotation and for more than two rotations. The CPU 40 repeats the on/off operation for a total of seven sets. When the cleaning liquid 92 soaks the nozzle face 111, the part of the nozzle face 111 where the nozzle arrays 122 to 124 are located and the part of the cap 67 that is inside the second area 662 are cleaned by the cleaning liquid 92. And because the cleaning liquid 92 flows to the waste liquid tank 706 through the waste liquid flow paths 762, 763, the waste liquid flow paths 762, 763 are also cleaned.

Next, the CPU 40 performs the discharge processing (Step S15), which discharges the cleaning liquid 92 from the second area 662 through the waste liquid flow paths 762, 763. In the discharge processing (Step S15), the CPU 40 leaves the supply on-off valve 722 and the waste liquid on-off valve 772 open and opens the air on-off valve 743, then operates the suction pump 708 at the fourth rotation speed. The suction force of the suction pump 708 causes air to flow into the second area 662 through the gas flow path 733 and also causes the cleaning liquid 92 in the second area 662 to be drained into the waste liquid tank 706 through the waste liquid flow paths 762, 763, in the same way that is shown in FIG. 13 for the first area 661.

Next, the CPU 40 operates the third drive portion 196 (refer to FIG. 6) to form a gap between the nozzle face 111 and the perimeter of the cap 67 (Step S16). Next, the CPU 40 leaves the waste liquid on-off valve 772 open and closes the supply on-off valve 722 and the air on-off valve 743, then operates the suction pump 708 (Step S17). The suction force of the suction pump 708 causes air to flow into the second area 662 through the gap in the perimeter of the cap 67 in the same way that was done for the first area 661. The inflowing air removes bubbles of the cleaning liquid 92 that are clinging to the cap lip 676 and causes the removed bubbles to flow to the waste liquid tank 706 through the waste liquid flow paths 762, 763.

Next, the CPU 40 operates the third drive portion 196 to move the cap support portion 69 downward, thus moving the cap 67 to the cap withdrawn position (refer to FIG. 7) (Step S18). The cap 67 thus enters the non-covering state, in which the cap 67 no longer covers the nozzle face 111, in the same way that was done for the first area 661.

Next, in the same manner as at Step S9, the CPU 40 performs the wiping processing (Step S19), which performs the nozzle face wiping operation. Next, in the same manner as at Step S10, the CPU 40 performs the wiper wiping operation (Step S20). Next, in the same manner as at Step S11, the CPU 40 operates the third drive portion 196 (refer to FIG. 6) to move the cap support portion 69 upward, thus moving the cap 67 from the cap withdrawn position (refer to FIG. 7) to the covering position (refer to FIGS. 3 and 9) (Step S21). The cap 67 thus enters the covering state in which the cap 67 covers the nozzle face 111. Next, the CPU 40 terminates the processing, leaving the cap 67 in the covering state. In other words, the state in which the nozzles 112 that are provided in the nozzle face 111 are covered by the cap 67 is continued.

As described above, after the first purge (Step S2), with the cap 67 in the covering state on the nozzle face 111, and with the supply on-off valve 721 in the open state, the CPU 40 performs the injection processing (Step S4) by operating the suction pump 708 at the second rotation speed, which is slower than the first rotation speed. In the injection processing (Step S4), the cleaning liquid 92 is injected into the cap 67 and soaks the nozzle face 111. Because the suction pump 708 is operated at the second rotation speed, which is slower than the first rotation speed, the negative pressure within the cap 67 is lower than it would be if the suction pump 708 were operated at the first rotation speed. If the suction pump 708 were to be operated at the first rotation speed in the injection processing (Step S4), the negative pressure within the cap 67 would become higher. Because the ink 91 has a higher viscosity than the cleaning liquid 92 and the higher negative pressure would cause the ink 91 to be drawn out of the nozzles 112 more readily, the ratio of the ink 91 that would be drained out become increase. Therefore, operating the suction pump 708 at the second rotation speed makes it possible to decrease the amount of the ink 91 that is discharged from the nozzles 112 below the amount that would be discharged if the suction pump 708 were to be operated at the same first rotation speed as at Step S2. Therefore, when the cleaning liquid 92 is injected into the cap 67, the amount of the ink 91 that is discharged into the cap 67 from the nozzles 112 as the nozzle face 111 is cleaned can be reduced. The injection processing for the second area 662 (Step S14) is performed in the same manner.

In the injection processing (Step S4), the CPU 40 operates the suction pump 708 intermittently. When the suction pump 708 is operating, the negative pressure inside the cap 67 becomes higher, and when the operation of the suction pump 708 stops, the negative pressure inside the cap 67 becomes lower. Therefore, when the suction pump 708 is operated intermittently, the negative pressure inside the cap 67 can be inhibited from becoming too high more easily than when the suction pump 708 is operated continuously. Therefore, when the cleaning liquid 92 is injected into the cap 67 and soaks the nozzle face 111, the amount of the ink 91 that is discharged from the nozzles 112 due to the higher negative pressure inside the cap 67 can be reduced below what it would be if the suction pump 708 were to be operated continuously. That is, the ratio of the ink 91 in the discharged liquid can be reduced. The injection processing for the second area 662 (Step S14) is performed in the same manner.

In the injection processing (Step S4), the CPU 40 operates the suction pump 708 at the second rotation speed, which is not greater than 800/3000 of the first rotation speed. Therefore, the injection speed of the cleaning liquid 92 is not as fast as it would be if the suction pump 708 were operated at the first rotation speed, so the cleaning liquid 92 can be discharged to the waste liquid flow paths 761, 763 more reliably as it soaks the nozzle face 111. The injection processing for the second area 662 (Step S14) is performed in the same manner.

The CPU 40 performs the second purge (Step S3) between the first purge (Step S2) and the injection processing (Step S4). In the second purge (Step S3), the CPU 40 operates the suction pump 708 at the third rotation speed to take the ink 91 that has been discharged from the nozzles 112 and drain it out through the waste liquid flow paths 761, 763. In the injection processing (Step S4), the CPU 40 operates the suction pump 708 at the second rotation speed, which is greater than the third rotation speed. Therefore, the second purge (Step S3) is able to use air to discharge the ink 91 that is discharged from the nozzles 112 during the first purge (Step S2). The ink 91 that remains inside the cap 67 can be reduced accordingly. In the injection processing (Step S4), the suction pump 708 is operated at the second rotation speed, which is greater than the third rotation speed, so the cleaning liquid 92 can soak the nozzle face 111 more reliably.

In the injection processing (Step S4), the cleaning liquid 92 soaks the nozzle face 111, and the nozzle face 111 is cleaned by the cleaning liquid 92. Therefore, fewer of the constituents of the ink 91 remain on the nozzle face 111 than would be the case if the nozzle face 111 were not cleaned by the cleaning liquid 92. In other words, the ink 91 is diluted by the cleaning liquid 92. Therefore, the ratio of the ink 91 in the liquid that splatters off of the nozzle face 111 and the wiper 31 can be reduced by the wiping processing (Step S9). Furthermore, because the amount of the ink 91 that adheres to the wiper 31 is reduced, the replacement interval for the absorption member 51, which wipes off the ink 91 that adheres to the wiper 31, can be lengthened.

The viscosity of the ink 91 is higher than that of the cleaning liquid 92, due to constituents such as resins and the like that are contained in the ink 91. The cleaning liquid 92 cleans the nozzle face 111 by soaking the nozzle face 111, so the wiping processing (Steps S9, S19) removes the high-viscosity ink 91 from the nozzle face 111 more easily than would be the case if the nozzle face 111 was not soaked, such that the ink 91 adhered to nozzle face 111 without being diluted by the cleaning liquid 92. Accordingly, the possibility can be reduced that the ink 91 will remain, hardening and binding to the nozzle face 111. The nozzles 112 are therefore more resistant to clogging, and the possibility that the printing quality will be impaired can be reduced.

After the ink 91 that has been discharged from the nozzles 112 has been drained out of the cap 67 (refer to FIG. 11) by the second purge (Steps S3, S13), the cleaning liquid 92 is supplied to the cap 67 in the injection processing (Steps S4, S14), and the nozzle face 111 is cleaned (refer to FIG. 12). Therefore, the amount of the ink 91 that remains in the cap 67 is less than would be the case if the cleaning liquid 92 were supplied to the cap 67 in a state in which the ink 91 that had been discharged from the nozzles 112 had not been drained out. The nozzle face 111 can therefore be cleaned thoroughly, because, in the cleaning liquid 92 that has been injected by the injection processing (Steps S4, S14) and that soaks the nozzle face 111, the ratio of the ink 91 has been reduced. Accordingly, the nozzle face 111 is cleaned more reliably. The nozzles 112 are therefore more resistant to clogging, and the possibility that the printing quality will be impaired can be reduced.

The second purge (Steps S3, S13) is also performed, so the amount of the ink 91 that remains in the cap 67 is less than would be the case if the ink 91 that was discharged from the nozzles 112 were not drained out. The amount of the ink 91 that adheres to the nozzle face 111 is thereby reduced, and the amount of the cleaning liquid 92 for diluting and cleaning off the adhered ink 91 is also reduced. Therefore, the nozzle face 111 can be cleaned, even as the amount of the cleaning liquid 92 that is used is reduced. The nozzles 112 are therefore more resistant to clogging, and the possibility that the printing quality will be impaired can be reduced.

Note that the present disclosure is not limited to the embodiment that is described above, and various types of modifications can be made. For example, it is acceptable for the partition wall 673 not to be provided in the cap 67. In that case, the first area 661 and the second area 662 would also cease to exist, so it would be possible to inject the cleaning liquid 92 into the interior of the cap 67 only once, and to remove the cleaning liquid 92 only once.

The head 110 of the head unit 200 discharges the color inks cyan, magenta, yellow, and black, so it is preferable for the cap 67 of the head unit 200 to have a separate area for each color, so as to avoid mixing the colors. However, if the composition of the black ink is different from the composition of the cyan, magenta, and yellow inks, the first area 661 may be provided in the cap 67 for the black ink only, with the second area 662 being provided for the cyan, magenta, and yellow inks. On the other hand, the head unit 100 discharges the white ink from all four of the nozzle arrays 121 to 124, so the cap 67 of the head unit 100 does not need to be divided into separate areas. However, in order to reduce the cost, it is preferable for the cap 67 of the head unit 100 to be the same as the cap 67 of the head unit 200. That would create the first area 661 and the second area 662 with different volumes, as described previously, so the injection processing would be performed separately for the first area 661 and the second area 662. In a case where the cap 67 is divided into the first area 661 and the second area 662, the second area 662 has a greater volume than does the first area 661. Therefore, if suction is applied to both areas at once, the nozzle arrays 122 to 124 that face the second area 662 would be harder to soak than the nozzle array 121 that faces the first area 661.

Therefore, in the embodiment that is described above, the maintenance processing for the first area 661 and the maintenance processing for the second area 662 are performed separately. In this case, the suction pump 708 does not apply suction through two flow paths simultaneously, such that the liquid is not drawn only from the side where the load is lighter. One example of the side where the load is lighter would be the first area 661 of the cap 67, whose volume is smaller than that of the second area 662. Another example would be if one of the first area 661 and the second area 662 had a shape that made it easier to drain out the liquid. Yet another example would be if one of the waste liquid flow paths 761, 762 was connected to the corresponding one of the first area 661 and the second area 662 in a position made it easier to drain out the liquid. It is therefore possible to draw out precisely the intended amounts of liquid from each one of the first area 661 and the second area 662 inside the cap 67. Accordingly, the nozzle faces 111 that respectively correspond to the first area 661 and the second area 662 are easily soaked.

The maintenance processing may also be performed first for the second area 662 (Steps S11 to S20) and then for the first area 661 (Steps S1 to S10). The maintenance processing may also be performed in the sequence Step S1, Step S12, Step S13, Step S2, Step S3, Step S4, Step S14, Step 5, Step S15, Steps S6 and S16, Steps S7 and S17, Steps S8 and S18, Steps S10 and S20, and Step S21. In that case, the operations could be performed more efficiently, because the number of times that the air on-off valve 743 is switched between open and closed, the number of times that the suction pump 708 is started and stopped, the control that changes the rotation speed of the suction pump 708, the number of times that the head 110 moves, and the number of times that the cap 67 moves up and down would all be decreased.

The CPU 40 may also perform the injection processing (Steps S4, S14) as hereinafter described. In the injection processing, the CPU 40 first operates the valves. For example, the CPU 40 opens the supply on-off valve 721 and the waste liquid on-off valve 771 and closes the air on-off valve 743, as shown in FIG. 12. Next, the CPU 40 performs first injection processing. In the first injection processing, the CPU 40 operates the suction pump 708 at the second rotation speed for a specified number of rotations. The second rotation speed may be 800 rpm, for example. Note that the second rotation speed may be greater than the third rotation speed at Step S3. In a case where the suction pump 708 is a tube pump, the CPU 40 may operate the pump at the second rotation speed for two rotations, for example, but it is not limited to two rotations and may also operate the pump for one rotation and for more than two rotations. When the suction pump 708 is operated at the second rotation speed, the cleaning liquid 92 soaks the nozzle face 111.

Next, the CPU 40 stops the suction pump 708. The CPU 40 may stop the suction pump 708 for 1 second, for example. Next, the CPU 40 performs second injection processing. In the second injection processing, the CPU 40 operates the suction pump 708 at a fifth rotation speed for a specified number of rotations. The fifth rotation speed is slower than the second rotation speed, and may be 200 rpm, for example. In a case where the suction pump 708 is a tube pump, the CPU 40 may operate the pump at the fifth rotation speed for two rotations, for example, but it is not limited to two rotations and may also operate the pump for one rotation and for more than two rotations. Specifically, in the second injection processing, the CPU 40 operates the suction pump 708 at the fifth rotation speed, at which the cleaning liquid 92 dopes not soak the nozzle face 111. Next, the CPU 40 stops the suction pump 708. The CPU 40 performs a total of three sets of on/off operation, for example, with each set consisting of the first injection processing, stopping, the second injection processing, and stopping. In the modified example of the injection processing, as described above, times when the cleaning liquid 92 soaks the nozzle face 111 and does not soak the nozzle face 111 are repeated, but the first injection processing and the second injection processing do not necessary have to alternate. The first injection processing may also be performed continuously, and the second injection processing may also be performed continuously.

In the modified example of the injection processing that is described above, the cleaning liquid 92 does not soak the nozzle face 111 in the second injection processing, so the ratio of the cleaning liquid 92 in the discharged liquid increases, such that the waste liquid flow paths 761, 762, 763 and the interior of the cap 67 can be cleaned more thoroughly.

After performing the first injection processing that is described above, the CPU 40 may also perform third injection processing instead of the second injection processing. In the third injection processing, the CPU 40 operates the suction pump 708 with the cap 67 in the covering state and the air on-off valve 743 in the open state. In the third injection processing, because the suction pump 708 is operated with the cap 67 in the covering state and the air on-off valve 743 in the open state, air mixes with the cleaning liquid 92 to form bubbles, and the bubbles in the cleaning liquid 92 are able to clean the waste liquid flow paths 761, 762, 763 and the interior of the cap 67. The waste liquid flow paths 761, 762, 763 and the interior of the cap 67 can therefore be cleaned more thoroughly.

In the injection processing (Steps S4, S14), the CPU 40 may also operate the suction pump 708 continuously, instead of performing the on/off operation of the suction pump 708. In this case, the CPU 40 may open the air on-off valve 743 for a fixed time interval, such that air is drawn into the interior of the cap 67.

In the embodiment that is described above, after the processing at Steps S2 to S10 is performed for the first area 661, the processing at Steps S12 to S20 is performed for the second area 662, but the processing for the first area 661 and the second area 662 may also be performed at the same time. The number of the partition walls 673 is also not limited. For example, three of the partition walls 673 may be provided in the cap 67, and the three of the partition walls 673 may be affixed tightly to the corresponding boundaries between the plurality of the nozzle arrays 121 to 124. It is also acceptable for the partition wall 673 not to be provided. In that case, it would not be necessary to provide both the first flow path system 701 and the second flow path system 702, and a single flow path system would be preferable.

It is also acceptable not to provide the waste liquid on-off valves 771, 772. It is also acceptable not to provide the waste liquid tank 706. Steps S8, S18 may be performed to put the cap 67 into the non-covering state immediately after the cleaning liquid 92 has been drained out of the cap 67 in the discharge processing (Steps S5, S15), without the processing at Steps S6, S7, S16, S17 being performed.

It is also acceptable for the second purge (Steps S3, S13) not to be performed, such that the ink 91 is not drained out of the cap 67. In that case, the cleaning liquid 92 may be injected into the first area 661 and the nozzle face 111 may be cleaned in a state in which the ink 91 remains in the cap 67. The nozzle face 111 may also be cleaned in the injection processing (Steps S4, S14), without the first purge (Steps S2, S12) being performed and without the ink purge operation being performed. The ink 91 that is discharged from the nozzles 112 may also be a discharge agent that decolorizes a dyed cloth, for example.

The opposite end of the gas flow path 733 from the cap 67 is open to the atmosphere, but it may also be connected to a tank in which a gas is stored. In that case, the tank may store a gas other than air. The first rotation speed, the second rotation speed, the third rotation speed, the fourth rotation speed, the fifth rotation speed, the first time period, the second time period, and the specified number of rotations are not limited to the numerical values in the embodiment that is described above. A gas flow path may be connected to each one of the supply flow paths 711, 712, and an air on-off valve may be provided in each one of the gas flow paths.

One of all and a part of the control program that performs the maintenance processing that is described above may be stored in the ROM 41. That is, the control program can be stored in any type of storage device that can be read by the CPU 40. Typically, the storage device is a non-transitory storage medium such as a hard disk drive (HDD) or the like. The non-transitory storage medium does not need to include a transitory storage medium such as a transmission signal or the like. The control program may also be downloaded through a network such as the Internet or the like and then stored in the ROM 41.

The processor of the present disclosure is not limited to the CPU 40, and the CPU 40 may also be another electronic device, such as an application specific integrated circuit (ASIC) or a field programmable gate array (FPGA), for example. That is, an ASIC, for example, can be used instead of the CPU 40, the ROM 41, and the RAM 42. The functions of the processor of the present disclosure may also be distributed among a plurality of electronic devices, such as a plurality of CPUs or the like. The individual steps in the flowchart that is described above may also be performed by distributed processing among a plurality of electronic devices.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head provided with a nozzle face having a nozzle;

a cap configured to be affixed to the nozzle face and cover the nozzle;

a supply flow path connected to the cap and configured to supply a cleaning liquid to the interior of the cap;

a supply valve provided in the supply flow path and configured to open and close the supply flow path;

a waste liquid flow path connected to the cap and configured to drain off the cleaning liquid that has been supplied to the interior of the cap;

a pump connected to the waste liquid flow path;

a processor; and a memory storing computer-readable instructions which, when executed by the processor, perform processes including:

covering processing controlling the cap into a covering state in which the cap covers the nozzle;

first purge processing purging, in a state in which the cap is in the covering state and the supply valve is closed, an ink from the nozzle by operating the pump at a first rotation speed; and injection processing injecting, after the first purge processing and in a state in which the cap is in the covering state and the supply valve is open, the cleaning liquid into the interior of the cap by operating the pump at a second rotation speed to cause the cleaning liquid to soak the nozzle face, the second rotation speed being slower than the first rotation speed, wherein the injection processing includes performing, in a state in which the cap is in the covering state, a plurality of on/off operations of the pump intermittently during a predetermined period, each one of the on/off operations including operating the pump and stopping the pump.

2. A print device comprising:

a head provided with a nozzle face having a nozzle;

a cap configured to be affixed to the nozzle face and cover the nozzle;

a supply flow path connected to the cap and configured to supply a cleaning liquid to the interior of the cap;

a supply valve provided in the supply flow path and configured to open and close the supply flow path;

a waste liquid flow path connected to the cap and configured to drain off the cleaning liquid that has been supplied to the interior of the cap;

a pump connected to the waste liquid flow path;

a processor; and a memory storing computer-readable instructions which, when executed by the processor, perform processes including:

covering processing controlling the cap into a covering state in which the cap covers the nozzle;

first purge processing purging, in a state in which the cap is in the covering state and the supply valve is closed, an ink from the nozzle by operating the pump at a first rotation speed; and injection processing injecting, after the first purge processing and in a state in which the cap is in the covering state and the supply valve is open, the cleaning liquid into the interior of the cap by operating the pump at a second rotation speed to cause the cleaning liquid to soak the nozzle face, the second rotation speed being slower than the first rotation speed, wherein the injection processing includes operating the pump at the second rotation speed that is not greater than 800/3000 of the first rotation speed, wherein the injection processing includes performing, in a state in which the cap is in the covering state, a plurality of on/off operations of the pump intermittently during a predetermined period, each one of the on/off operations including operating the pump and stopping the pump.

3. A print device comprising:

a head provided with a nozzle face having a nozzle;

a cap configured to be affixed to the nozzle face and cover the nozzle;

a supply flow path connected to the cap and configured to supply a cleaning liquid to the interior of the cap;

a supply valve provided in the supply flow path and configured to open and close the supply flow path;

a waste liquid flow path connected to the cap and configured to drain off the cleaning liquid that has been supplied to the interior of the cap;

a pump connected to the waste liquid flow path;

a processor; and a memory storing computer-readable instructions which, when executed by the processor, perform processes including:

covering processing controlling the cap into a covering state in which the cap covers the nozzle;

first purge processing purging, in a state in which the cap is in the covering state and the supply valve is closed, an ink from the nozzle by operating the pump at a first rotation speed; and injection processing injecting, after the first purge processing and in a state in which the cap is in the covering state and the supply valve is open, the cleaning liquid into the interior of the cap by operating the pump at a second rotation speed to cause the cleaning liquid to soak the nozzle face, the second rotation speed being slower than the first rotation speed, wherein the print device further comprises:

a gas flow path connected to one of the cap and the supply flow path; and an air valve configured to open and close the gas flow path, wherein the computer-readable instructions, when executed by the processor, further perform processes including:

second purge processing purging, between the first purge processing and the injection processing, and in a state in which the cap is in the covering state and the air valve is open, the ink from the nozzle through the waste liquid flow path by operating the pump at a third rotation speed, wherein the injection processing includes operating the pump at the second rotation speed that is greater than the third rotation speed.

4. A print device comprising:

a head provided with a nozzle face having a nozzle;

a cap configured to be affixed to the nozzle face and cover the nozzle;

a supply flow path connected to the cap and configured to supply a cleaning liquid to the interior of the cap;

a supply valve provided in the supply flow path and configured to open and close the supply flow path;

a waste liquid flow path connected to the cap and configured to drain off the cleaning liquid that has been supplied to the interior of the cap;

a pump connected to the waste liquid flow path;

a processor; and a memory storing computer-readable instructions which, when executed by the processor, perform processes including:

covering processing controlling the cap into a covering state in which the cap covers the nozzle;

first purge processing purging, in a state in which the cap is in the covering state and the supply valve is closed, an ink from the nozzle by operating the pump at a first rotation speed; and injection processing injecting, after the first purge processing and in a state in which the cap is in the covering state and the supply valve is open, the cleaning liquid into the interior of the cap by operating the pump at a second rotation speed to cause the cleaning liquid to soak the nozzle face, the second rotation speed being slower than the first rotation speed, wherein the print device further comprises:

a wiper configured to slide on the nozzle face, and wherein the computer-readable instructions, when executed by the processor, further perform processes including:

uncovering processing controlling the cap from the covering state into a non-covering state, the non-covering state being a state in which the cap does not cover the nozzle;

discharge processing discharging, after the injection processing and in a state in which the cap is in the covering state, the cleaning liquid in the interior of the cap through the waste liquid flow path by operating the pump at a fourth rotation speed; and wiping processing wiping, after the discharge processing and in a state in which the cap is in the non-covering state, the nozzle face by sliding the wiper in relation to the nozzle face, wherein the injection processing includes performing, in a state in which the cap is in the covering state, a plurality of on/off operations of the pump intermittently during a predetermined period, each one of the on/off operations including operating the pump and stopping the pump.

5. The print device according to claim 4, wherein the uncovering processing includes controlling the cap into the non-covering state after the discharge processing.

6. A print device comprising:

a head provided with a nozzle face having a nozzle;

a cap configured to be affixed to the nozzle face and cover the nozzle;

a supply flow path connected to the cap and configured to supply a cleaning liquid to the interior of the cap;

a supply valve provided in the supply flow path and configured to open and close the supply flow path;

a waste liquid flow path connected to the cap and configured to drain off the cleaning liquid that has been supplied to the interior of the cap;

a pump connected to the waste liquid flow path;

a processor; and a memory storing computer-readable instructions which, when executed by the processor, perform processes including:

covering processing controlling the cap into a covering state in which the cap covers the nozzle;

first purge processing purging, in a state in which the cap is in the covering state and the supply valve is closed, an ink from the nozzle by operating the pump at a first rotation speed; and injection processing injecting, after the first purge processing and in a state in which the cap is in the covering state and the supply valve is open, the cleaning liquid into the interior of the cap by operating the pump at a second rotation speed to cause the cleaning liquid to soak the nozzle face, the second rotation speed being slower than the first rotation speed, wherein the injection processing includes first injection processing and second injection processing, the first injection processing injecting the cleaning liquid into the cap by operating the pump at the second rotation speed to cause the cleaning liquid to soak the nozzle face, and the second injection processing injecting the cleaning liquid into the cap by operating the pump at a fifth rotation speed to cause the cleaning liquid does not soak the nozzle face, the fifth rotation speed being slower than the second rotation speed.

7. A print device comprising:

a head provided with a nozzle face having a nozzle;

a cap configured to be affixed to the nozzle face and cover the nozzle;

a supply flow path connected to the cap and configured to supply a cleaning liquid to the interior of the cap;

a supply valve provided in the supply flow path and configured to open and close the supply flow path;

a waste liquid flow path connected to the cap and configured to drain off the cleaning liquid that has been supplied to the interior of the cap;

a pump connected to the waste liquid flow path;

a processor; and a memory storing computer-readable instructions which, when executed by the processor, perform processes including:

covering processing controlling the cap into a covering state in which the cap covers the nozzle;

first purge processing purging, in a state in which the cap is in the covering state and the supply valve is closed, an ink from the nozzle by operating the pump at a first rotation speed; and injection processing injecting, after the first purge processing and in a state in which the cap is in the covering state and the supply valve is open, the cleaning liquid into the interior of the cap by operating the pump at a second rotation speed to cause the cleaning liquid to soak the nozzle face, the second rotation speed being slower than the first rotation speed, wherein the print device further comprises:

a gas flow path connected to one of the cap and the supply flow path; and an air valve configured to open and close the gas flow path, wherein the injection processing includes first injection processing and third injection processing, the first injection processing injecting the cleaning liquid into the cap by operating the pump at the second rotation speed to cause the cleaning liquid to soak the nozzle face, and the third injection processing operating the pump in a state in which the cap is in the covering state and the supply valve and the air valve are open.

* * * * *